US005913587A

United States Patent [19]

Kuhasalo et al.

[11] Patent Number: 5,913,587

[45] Date of Patent: Jun. 22, 1999

[54] DRYER SECTIONS WITH INTERMEDIATE CALENDERING IN A PAPER MACHINE

[75] Inventors: Antti Kuhasalo; Juha Kaihovirta, both of Jyvaskyla; Allan Liedes, Palokka, all of Finland

[73] Assignee: Valmet Corporation, Helsinki, Finland

[21] Appl. No.: 08/918,787

[22] Filed: Aug. 25, 1997

Related U.S. Application Data

[63] Continuation-in-part of application No. 08/661,666, Jun. 11, 1996.

[30] Foreign Application Priority Data

Feb. 28, 1996 [FI] Finland ..... 960925

[51] Int. Cl.[6] ..... D21F 3/02

[52] U.S. Cl. ..... 34/117

[58] Field of Search ..... 34/117, 118, 120, 34/121; 162/206, 207, 358.5, 360.2; 100/38, 153, 335

[56] References Cited

U.S. PATENT DOCUMENTS

| | | | |
|---|---|---|---|
| 4,163,688 | 8/1979 | Kankanpaa | 162/359 |
| 4,568,423 | 2/1986 | Laapotti | 162/358 |
| 5,043,046 | 8/1991 | Laapotti | 162/358 |
| 5,071,513 | 12/1991 | Bluhm et al. | 162/206 |
| 5,127,168 | 7/1992 | Pikulik | 34/18 |
| 5,163,364 | 11/1992 | Bubik et al. | 100/38 |
| 5,551,164 | 9/1996 | Brunnmair et al. | 34/117 |
| 5,666,741 | 9/1997 | Bubik et al. | 34/117 |
| 5,756,156 | 5/1998 | Elijoki et al. | 34/114 X |

FOREIGN PATENT DOCUMENTS

| | | | |
|---|---|---|---|
| 2127767 | 1/1995 | Canada . | |
| 2143912 | 9/1995 | Canada . | |
| 2188969 | 4/1997 | Canada | D21F 5/02 |
| 2193554 | 6/1997 | Canada | D21F 5/02 |
| 0141614 | 5/1985 | European Pat. Off. . | |
| 0345500 | 12/1989 | European Pat. Off. . | |
| 0370185 | 5/1990 | European Pat. Off. . | |
| 0527881 | 2/1993 | European Pat. Off. . | |
| 810933 | 9/1981 | Finland . | |
| 4322876 | 11/1993 | Germany . | |
| 4407405 | 9/1995 | Germany . | |
| 29510637 | 11/1995 | Germany | D21F 5/00 |
| 19604675 | 8/1997 | Germany | D21F 5/04 |
| 56040/1992 | 8/1993 | Japan . | |
| 9732080 | 9/1997 | WIPO | D21F 5/04 |

OTHER PUBLICATIONS

U.S. Patent Application Serial No. 06/134,418, Filed Mar. 27, 1980 By John G. Edwards, "Apparatus For Press Drying".

*Primary Examiner*—Henry Bennett
*Assistant Examiner*—Steve Gravini
*Attorney, Agent, or Firm*—Steinberg & Raskin, P.C.

[57] ABSTRACT

A dryer section of a paper machine which is provided with at least one intermediate calendering nip and includes several successively arranged wire groups. The dryer section primarily or exclusively has groups with single-wire draw in which heated drying cylinders are arranged in an upper row and reversing suction cylinders or reversing suction rolls are arranged in a lower row below the upper row. The groups with single-wire draw also have a drying wire which runs along a meandering path over the drying cylinders and reversing suction cylinders or rolls so that the reversing suction cylinders remain inside the loop of the drying wire. Two calender rolls are arranged to form the calendering nip through which a paper web to be dried is passed, and thus calendered inside the dryer section, immediately preceding or following or within one or more of the dryer groups of the dryer section.

18 Claims, 25 Drawing Sheets

Rn
22b
21
10
10'
15
W
20
20a
28
S
29
NK
23
30
31
28'
Rn-1
22ap
W
21
20
25
20a
29'

10p
Rn
22b
21
10P'
W
27
W
NKP
23
30
31
20a
Rn-1
21
22ap
20
25

DRYER SECTIONS WITH INTERMEDIATE CALENDERING IN A PAPER MACHINE

This application is a continuation-in-part of U.S. patent application Ser. No. 08/661,666 filed Jun. 11, 1996.

FIELD OF THE INVENTION

The present invention relates to dryer sections of a paper machine which are provided with one or more intermediate calendering nips and in which there is one wire group or several successively arranged wire groups.

BACKGROUND OF THE INVENTION

As known from the prior art, in a dryer section of a paper machine, single-wire draw or twin-wire draw or various combinations of the same are employed. In single-wire draw, so-called "normal groups with single-wire draw" are used, in which drying cylinders are arranged in an upper row and reversing suction cylinders or rolls are arranged in a lower row below the upper row of drying cylinders. In this case, the dryer section is open toward the bottom, for example, to enable easy removal of broke. In so-called "inverted groups with single-wire draw", the drying cylinders are arranged in a lower row and the reversing suction cylinders or rolls are arranged in an upper row above the lower row of reversing suction cylinders or rolls. In this case, it is a recognized drawback that the inverted groups are closed toward the bottom and, for example, there are problems associated with the removal of broke because it cannot be arranged to take place by the force of gravity (which is how it is done in "normal groups with single-wire draw").

In the past, in the dryer section of a paper machine, so-called breaker stacks (intermediate calenders) were employed quite commonly, which stacks are usually arranged between groups with twin-wire draw (which will be discussed below). These breaker stacks have been largely abandoned, partly because of runnability problems, and partly because their use causes an increase in the length of the dryer section in the machine direction since, between a breaker stack and the wire groups preceding and following it, it was usually necessary to provide relatively long unsupported draws of the web. Such draws are susceptible to fluttering and web breaks and are also problematic in view of the threading of the web.

In recent years, some breaker stacks arranged inside dryer sections have been suggested, which stacks are formed between heated drying cylinders and particular calender rolls. With respect to this prior art, reference is made, as an example, to the U.S. Pat. No. 5,127,168, to published German Patent Application No. DE 4,407,405 A1 (which corresponds to English-language Canadian Patent Application No. 2,143,912), and to a press section marketed by Black Clawson-Kennedy Inc. under the trademark "HYDRA NIP"™. It is not known if a patent or patent application in respect of the latter press section has been filed or issued. With respect to the prior art, reference is made further to Japanese Patent Application No. 56040/1992 (published application No. 222691/1993), in the name of Mitsubishi Heavy Industries Ltd.

In FIG. 5 in U.S. Pat. No. 5,127,168, an arrangement is illustrated in which a first nip of intermediate calendering is formed in connection with the first cylinder in the first group with twin-wire draw in a multi-cylinder dryer, and a water-receiving felt of the press section of the paper machine is passed through this first nip of intermediate calendering. A second nip of intermediate calendering is formed in connection with the first lower cylinder in the second group with twin-wire draw. It is a drawback of the arrangement of intermediate calendering known from this U.S. patent that in the group gap in which an intermediate calendering nip is used, the web will have a very long unsupported draw, and further, it is a disadvantage that the group gap makes the dryer section remarkably longer in the machine direction. The U.S. patent also does not suggest any solutions for carrying out intermediate calendering in modern dryer sections in which groups with single-wire draw and closed draw of the web are applied.

In FIG. 1 of German Patent Application No. DE 4,407,405, an arrangement of intermediate calendering is illustrated in which an intermediate calendering nip is arranged in connection with the last drying cylinder in an inverted group with single-wire draw. The arrangement of intermediate calendering in accordance with the German patent application involves the drawback that the group gaps in which intermediate calendering is applied become relatively long and spacious in the machine direction and thereby unduly increase the length of the dryer section in the machine direction. Moreover, in the German patent application, an arrangement of intermediate calendering is described as being applied in connection with an inverted group with single-wire draw and in group gaps between such an inverted group and a normal group with single-wire draw only. As such, the German patent application does not suggest any solution for intermediate calendering in dryer sections in which exclusively normal groups with single-wire draw or various combinations of such groups and groups with twin-wire draw or combinations of such groups and so-called hybrid groups are employed.

In particular in connection with modernizations of paper machines, for example in order to increase their running speed, it is also necessary to increase the drying capacity of the dryer section. The prior art arrangements of intermediate calendering mentioned above, with the exception of that described in U.S. Pat. No. 5,127,168, are not suitable for modernizations of paper machines, because they increase the length of the dryer section and/or reduce the drying capacity.

OBJECTS AND SUMMARY OF THE INVENTION

Accordingly, it is an object of the present invention to provide novel applications for intermediate calendering taking place inside the dryer section, which intermediate calendering in itself involves a number of obvious and well-known advantages.

It is a particular object of the present invention to provide novel arrangements of intermediate calendering inside the dryer section, in particular in dryer sections in which closed single-wire draw is applied, preferably so that exclusively so-called normal groups with single wire draw are employed and inverted groups are not used at all (because the use of inverted groups involves the problems discussed above, mainly related to broke removal).

It is a further object of the present invention to provide arrangements of intermediate calendering arranged inside the dryer section in most of which it is possible to apply supported and closed draw of the web so that the web is constantly supported by a drying wire over the entire length of the dryer section, with the exception of a possible last group with twin-wire draw. In this manner, web breaks and shrinkage of the web in the cross direction, in particular at the dry end of the dryer section and especially at a dry solids content higher than about 60 percent, are substantially excluded.

It is a further object of the present invention to retain the advantages, in themselves known, of intermediate calendering taking place in the dryer section, which advantages have been described in more detail, e.g., in U.S. Pat. No. 5,127,168. Notable advantages include improved printing quality of paper reduced unequalsidedness of paper and an improvement of the drying efficiency in spite of the intermediate calendering, or at least an absence of a detrimental change in the drying efficiency of the dryer section.

It is a further object of the present invention to provide such dryer sections provided with intermediate calendering which are particularly well suitable for modernizations of paper machines, so that intermediate calendering can be arranged in existing machines or in connection with modernizations of dryer sections, for example when the running speed of a machine is increased.

It is still another object of the present invention to be able even to increase the drying capacity in spite of intermediate calendering.

It is another important object of the present invention to permit construction of a paper machine in which the machine stack can be omitted completely, in which case, in modernizations, the dryer section can be extended to the space previously occupied by the machine stack, whereby, among other things, the drying capacity can be increased or, in the case of new constructions, even the length of the paper machine hall can be reduced.

It is another object of the present invention to facilitate the calendering of a web in connection with a dryer section, single-wire draw or twin-wire draw, wherein the web is calendered by passing through two calender rolls.

In view of achieving the objects stated above, those that will come out later, and others, a first embodiment of the dryer section in accordance with the present invention comprises primarily or exclusively groups with single-wire draw in which heated drying cylinders are arranged in an upper row and reversing suction cylinders or equivalent reversing suction rolls are arranged in a lower row below the upper row and a drying wire runs along a meandering path over the drying cylinders and reversing suction cylinders or rolls whereby the reversing suction cylinders are inside a loop of the drying wire. In connection with an intermediate drying cylinder situated inside the group with single-wire draw or in connection with the last drying cylinder in the group, a free space has been arranged in which a calender roll is arranged. The calender roll is arranged to form a calendering nip together with the drying cylinder in or in association with the free space and through which nip, a paper web to be dried is passed and thus calendered inside the dryer section.

In the alternative, two calender rolls may be arranged inside the group with single-wire draw or before and/or after a normal group with single-wire draw, and form a calendering nip with each other through which the web is passed and calendered. In the latter case, the dryer section does not include an inverted group with single-wire draw, i.e., one having heated drying cylinders arranged in one row and reversing suction cylinders or rolls arranged in another row above the row of drying cylinders, situated adjacent the calendering nip formed by the calender rolls. In addition, the calendering nip is not situated between normal group with single-wire draw and an inverted group with single-wire draw.

A second embodiment of the dryer section in accordance with invention comprises an initial portion provided with groups with single-wire draw, after which there is one or more, preferably only one, group with twin-wire draw in which there are two rows of heated drying cylinders between which the web has free unsupported draws, an upper wire and a lower wire engaging the web and for contacting the web against the drying cylinders in a respective row. On the latter half of the last heated drying cylinder in the normal group with single-wire draw preceding the group with twin-wire draw, a calendering nip for calendering the web that is being dried is arranged. The calendering nip is formed by the last-mentioned drying cylinders together or with a smooth-faced calendering roll, and through which calendering nip the paper web to be dried is passed and, thus, calendered inside the dryer section. In the alternative, the calendering nip may be formed by two calender rolls, instead of one calender roll and one drying cylinder, and may be arranged between the twin-wire draw group and the immediately preceding single-wire draw group.

A third embodiment of the dryer section in accordance with the invention comprises groups with twin-wire draw, or it includes, at least as one group, preferably as the last group, a group with twin-wire draw, whereas the preceding groups are groups with single-wire draw. In the place of a drying cylinder or cylinders in the group with twin-wire draw, a calendering roll is arranged to form a calendering nip with an opposite drying cylinder arranged in the opposite row. The drying wire of the row of the omitted drying cylinder is passed by means of guide rolls from the preceding drying cylinder in the row onto the next drying cylinder to support the paper web that runs over the calender roll and that has been calendered and/or is being calendered in the calendering nip.

In an alternative to this embodiment, two calender rolls may be arranged to form a calendering nip in the group with twin-wire draw. In such an embodiment, the web is guided from a drying cylinder in the first row into the calendering nip and from the calendering nip to a drying cylinder in the second row. More specifically, the web may be transferred from the drying cylinder in the first row onto an outer surface of one calender roll, run between the outer surface and one of the drying wires over a sector of the calender roll, run over an additional sector of that calender roll into the calendering nip, run over a sector of the other calender roll in which the web has an exposed face and then between the outer surface of the other calender roll and the other drying wire over a sector thereof and be transferred therefrom to the drying cylinder in the second row. The calender rolls may be arranged between a pair of drying cylinders in the respective row of drying cylinders.

A fourth embodiment of the dryer section in accordance with invention comprises a group or groups with single-wire draw in which heated drying cylinders are arranged in an upper row and reversing suction cylinders or equivalent reversing suction rolls are arranged in a lower row below the upper row, and a drying wire runs along a meandering path over the drying cylinders and reversing suction cylinders or rolls so that the reversing suction cylinders remain inside the loop of the drying wire. In the group or groups with single-wire draw, in place of one or more reversing suction cylinders or above two successively arranged drying cylinders, a calender roll is arranged between two successively arranged drying cylinders so that the calender roll forms two successive calendering nips with the last-mentioned two successively arranged drying cylinders.

A fifth embodiment of the dryer section in accordance with the invention comprises one or more so-called hybrid groups, preferably as the last drying group in the dryer section, in which both a portion with twin-wire draw and a portion with single-wire draw are employed. On the last or first lower drying cylinder after the portion with twin-wire draw or the portion with single-wire draw in the hybrid group, a calendering nip is arranged. The calendering nip is formed between a calender roll and the lower drying cylinder. In the alternative, the calendering nip is formed between two calender rolls whereby one calender roll is arranged in the single-wire draw portion, the web being provided with a free draw to and from this calender roll such that the web runs on an outer surface thereof.

A sixth embodiment of the dyer section in accordance with the invention comprises an intermediate calendering nip arranged between two normal groups with single-wire draw in which drying cylinders are arranged in an upper row and reversing suction cylinders or equivalent reversing suction rolls are arranged in a lower row below the upper row. After the last reversing suction cylinder or equivalent roll in the preceding group, the calendering roll is arranged, above which there is a drying cylinder or an equivalent calender roll, which is arranged to form the calendering nip with the first-mentioned calender roll. After the calendering nip, the paper web is passed onto the drying wire of the next group when the wire runs over the last reversing suction cylinder or equivalent reversing suction roll in the latter group.

Even though, in the present invention, six embodiments defined above have been described, which are seemingly different from one another, it is a feature and advantage common of these embodiments that the intermediate calendering can be arranged inside the dryer section without increasing the length of the dryer section and while substantially not lowering the drying capacity of the dryer section and while, at the same time, retaining the draw of the web so that the runnability of the paper machine remains good.

In the present invention, as a nip of intermediate calendering it is possible to use extended nips in themselves known, either extended nips provided by means of a press shoe, series of shoes, or by means of a press belt, which nips are known in themselves in the art of calendering of paper. In this respect, reference is made, by way of example only, to European Patent Publication Nos. 0,370,185 B1 (corresponding to U.S. Pat. No. 5,163,364) and 0,141,614 A1 as well as to published German Patent Application No. 43,22,876 A1. In respect of the details of the constructions of the extended-nip rolls that are suitable for use in intermediate calendering nips in accordance with the present invention, reference is made, by way of example only, to the current assignee's following patents: Finnish Patent No. 70,952 (corresponding to U.S. Pat. No. 4,568,423, incorporated by reference herein), European Patent Publication No. 0,345,500 and European Patent Publication No. 0,527,881.

When extended-nip calendering is employed, an advantage is also obtained in that, besides an adequate calendering effect, the profile of the nip pressure can be controlled both in the machine direction and in the cross direction.

In spite of the novel features of the present invention, when the invention is applied, the general advantages of intermediate calendering are retained, which advantages are well known in themselves and which are related to improved quality properties of paper, such as smoothness of both faces of the paper and reduced unequalsidedness, as well as to increased drying efficiency in some embodiments of the invention.

In the following, the invention will be described in detail with reference to some exemplifying embodiments of the invention illustrated in the figures in the accompanying drawings. However, the invention is by not strictly confined to the details of these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
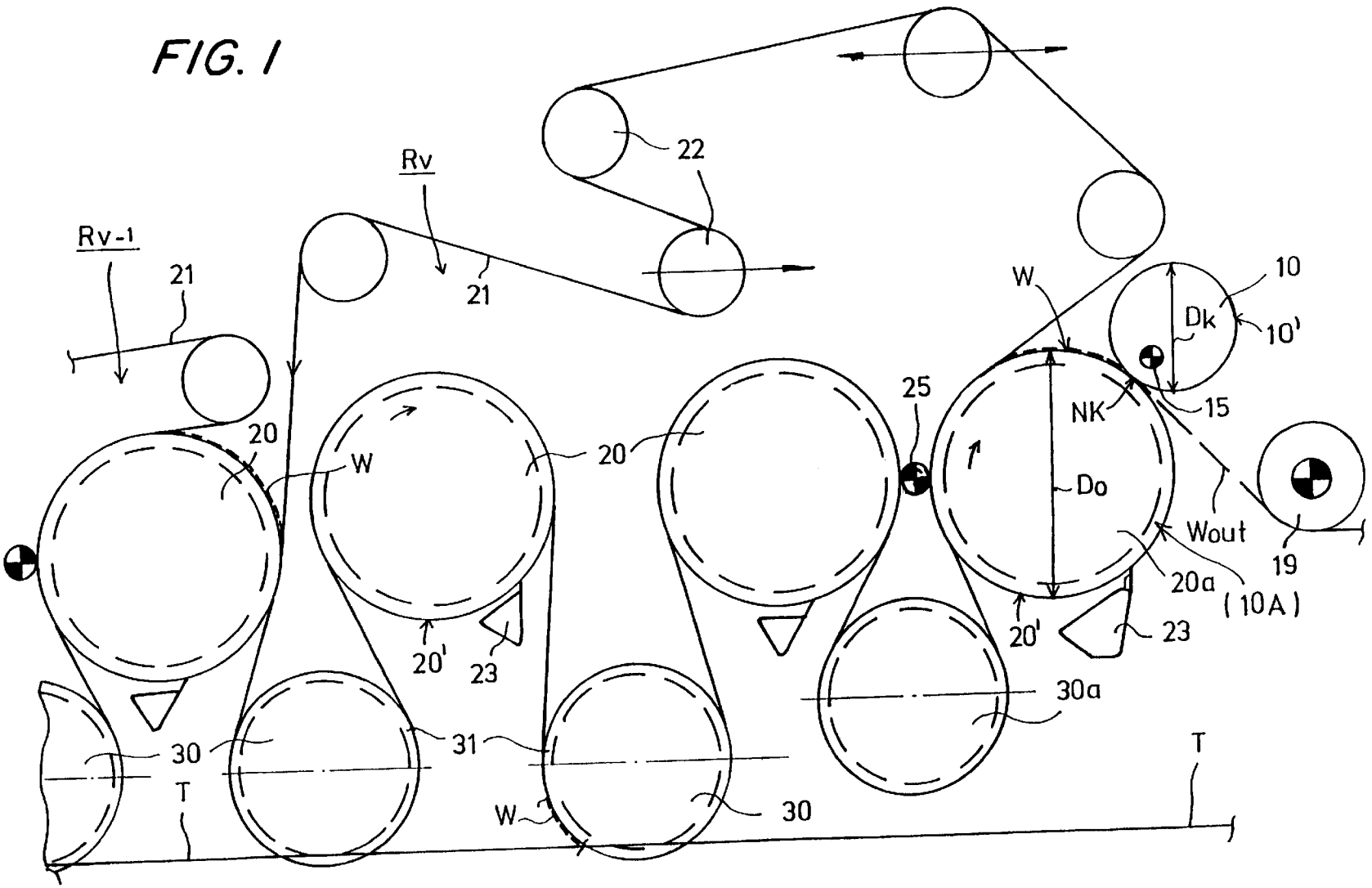
FIG. 1 shows a first embodiment of a dryer section in accordance with the invention in which a breaker stack (intermediate calender) is arranged in connection with the last drying cylinder in the last normal group with single-wire draw in the dryer section.

Referring to the accompanying drawings wherein the same reference numerals refer to the same or similar elements, initially, the first embodiment of the dryer section in accordance with the invention will be described with reference to FIGS. 1–3A. It should be understood though that features of the dryer sections shown in the embodiments of FIG. 4–11 may of course be incorporated in connection with the dryer sections shown in FIGS. 1–3A and vice versa.

FIG. 1 shows the final end, i.e., the dry end, of a dryer section comprising a number of drying groups, preferably exclusively normal single-wire groups. A paper web W to be dried is passed from the preceding group with single-wire draw $R_{V-1}$, to the last group with single-wire draw $R_V$. Each group with single-wire draw comprises steam-heated drying cylinders 20,20*a* having a smooth face 20' arranged in an upper row and reversing suction cylinders 30 or rolls, which are arranged in a lower row below the upper row of drying cylinders 20,20*a*. The reversing suction cylinders 30 or equivalent communicate with a source of vacuum through their axle journals and are provided with perforated and grooved mantles 31 through which the vacuum present in the interior of the cylinders 30 acts upon the web W through a drying wire 21 and keeps the web W in contact with the drying wire 21 against the effects of various forces applied to the web and arising from centrifugal forces and blowings. In this manner, breaks of the web W and excessive shrinkage of the web in the direction of the plane of the web, especially in the cross direction, are prevented by keeping the web W in reliable contact with the drying wire 21 over the entire length of the dryer section.

Between the groups with single-wire draw, whose number is generally between 4 and 10, a closed draw of the web is provided. The web W arrives from the last cylinder 20 in the preceding group $R_{V-1}$ onto the drying wire 21 of the last group $R_V$. The drying cylinders 20 are provided with drives 25 for rotating the same and doctors 23 for keeping the smooth faces 20' of the cylinders 20 clean, as well as associated surface heating means as is conventional in the art.

In connection with the last drying cylinder 20*a* in FIG. 1, in accordance with the present invention, a nip NK for intermediate calendering of the web W to be dried is arranged. Nip NK is formed between the smooth face 20' of the drying cylinder 20*a* and the calender roll 10, which is preferably provided with a soft coating 10'. The drying cylinder 20*a* may be provided with reinforcement means to provide structural integrity thereto. The drying wire 21 is separated from the drying cylinder 20*a* before the calendering nip NK so that the web has an exposed face as it passes through the calendering nip NK. The scope of the invention also includes such a variation of the embodiment as shown in FIG. 1 in which the drying cylinder 20*a* has been substituted for by a normal heated or non-heated calender roll, to which reference is made in FIG. 1 by means of the reference (10A) in brackets. (This embodiment is shown in FIG. 1B described below.) The diameter DK of the calender roll 10 is preferably about half the diameter $D_0$ of a drying cylinder. After the calendering nip NK, the web W is passed as a free draw $W_{out}$. onto a guide roll 19 and further to a finishing device, such as a reel-up. Owing to the intermediate calender nip NK or nips, a paper machine does not always necessarily require a separate machine stack, for example a so-called soft calender.

Figure 1A:
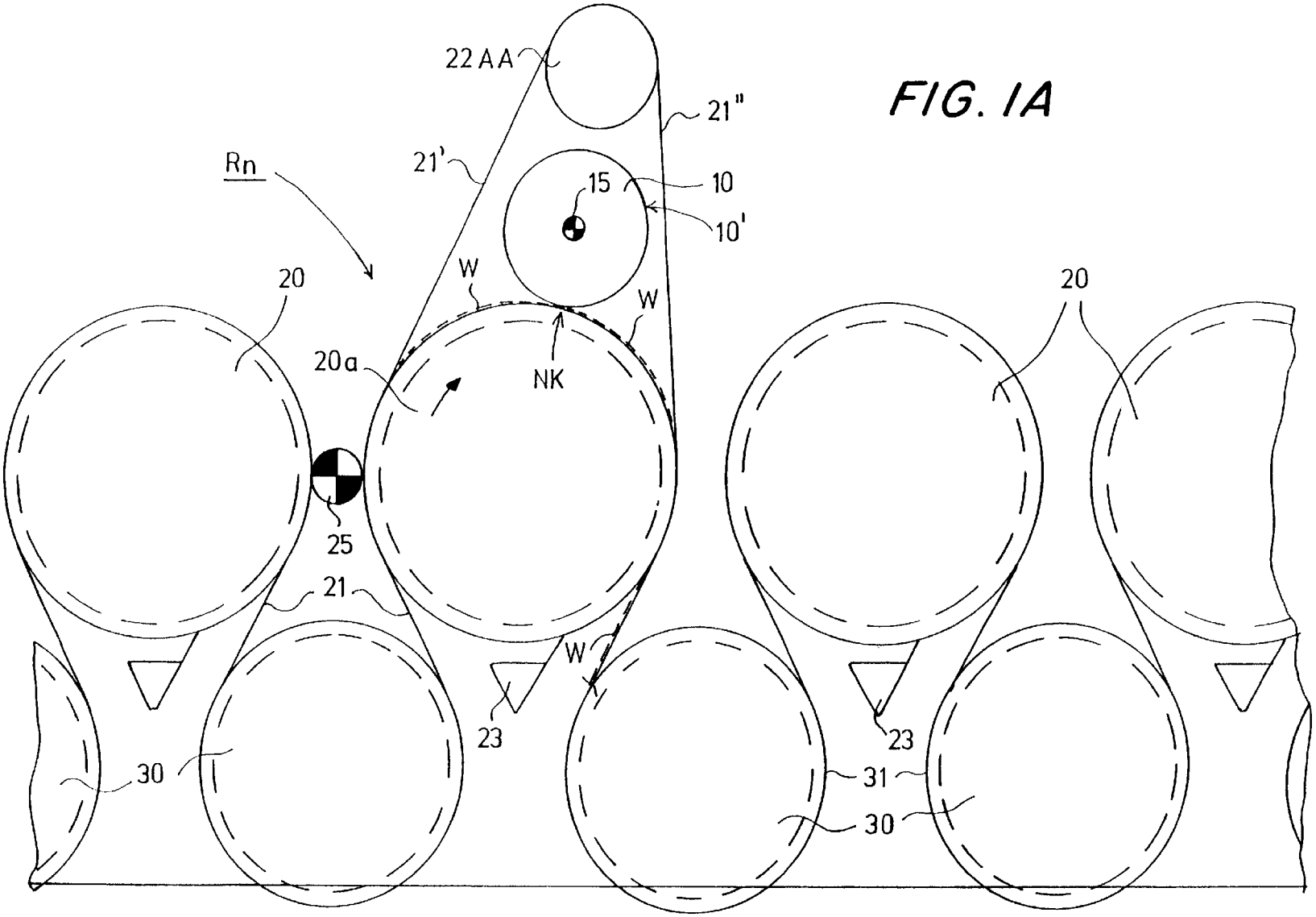
FIG. 1A shows a modification, included in the scope of the present invention, of the embodiment shown in FIG. 1 in which the intermediate calendering nip is arranged inside a group with single-wire draw, i.e., not formed in conjunction with the last drying cylinder in the group.
Figure 1B:
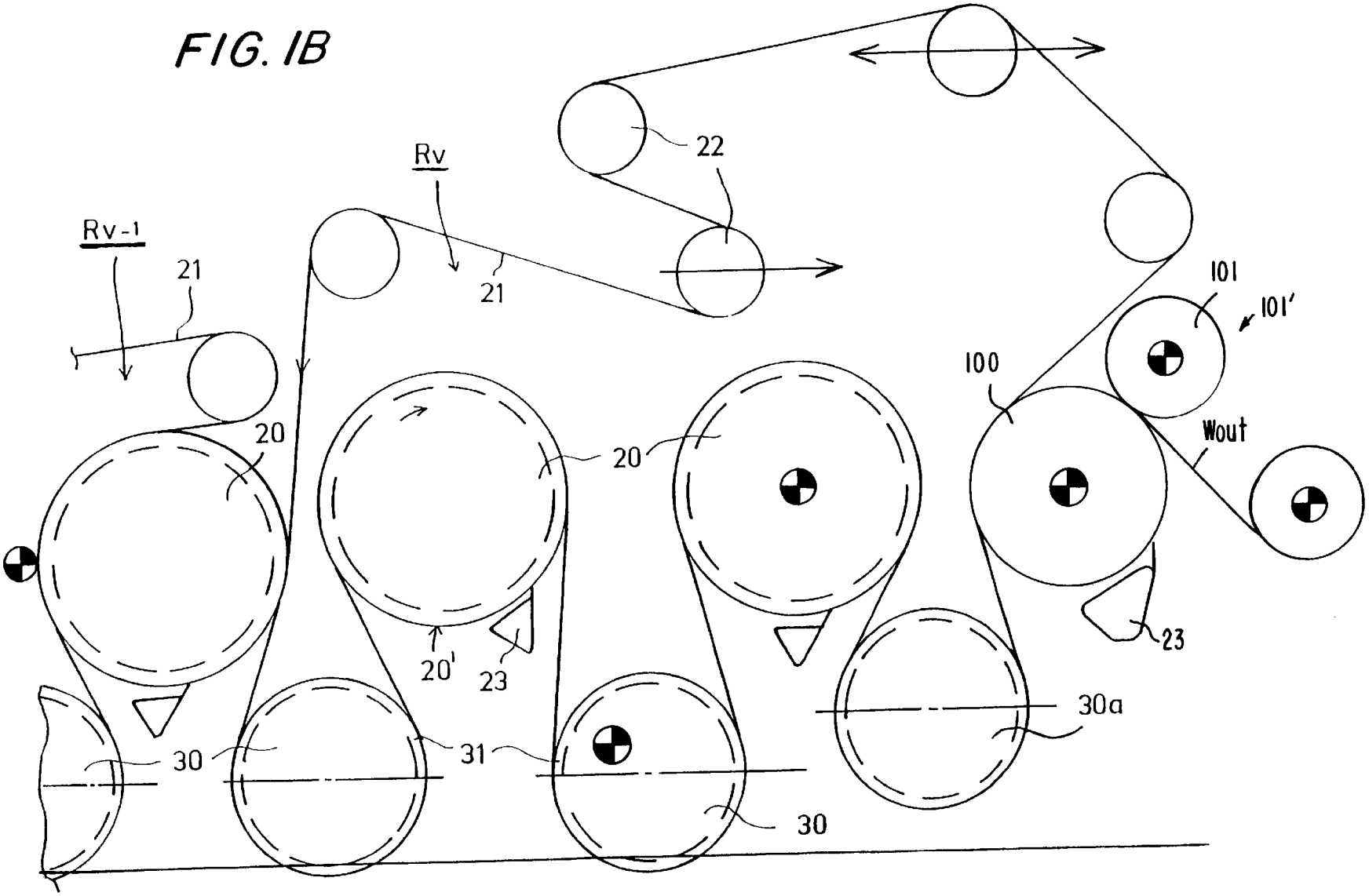
FIG. 1B shows a modification of the embodiment shown in FIG. 1 in which the last drying cylinder in the upper row in the last normal group with single-wire is replaced by a calender roll so that the calendering nip is formed by two calender rolls.

FIG. 1A shows an arrangement of intermediate calendering in which the nip NK of intermediate calendering is arranged inside a group with single-wire draw $R_n$. In order to form the nip NK of intermediate calendering, a guide roll 22AA for the drying wire 21 is arranged above one or several drying cylinders 20*a*, or at least spaced therefrom a certain distance. By means of the guide roll 22AA, the drying wire 21 is passed in a pair of straight runs 21' and 21" apart from the drying cylinder 20*a* and from the paper web W. Inside the wire runs 21' and 21" and underneath the guide roll 22AA, i.e., between a location at which the drying wire 21 is separated from the web and a location at which the drying wire 21 recontacts the web, a calender roll 10 is arranged, whose smooth face 10' forms the nip NK of intermediate calendering together with the drying cylinder 20*a* arranged below the calender roll. In other respects, the construction and the operation of the dryer section of FIG. 1A are similar to those described above in connection with FIG. 1. Thus, in general, the guide roll 22AA separates the wire from a face of the web at one location and returns the wire into contact with the web at a downstream location whereby in the interim, the web is passed through a calendering nip such that the exposed face of the web is accessible.

As shown in FIG. 1B, instead of the last drying cylinder 20*a* in the upper row of the last normal single-wire draw group as shown in the dryer section of FIG. 1, there is a calender roll 100 which forms a calendering nip NK with the calender roll 101 for calendering the web. The web runs on the surface of the calender roll 100 from its point of disengagement with the drying wire 21 into and through the calendering nip NK.

Figure 1C:
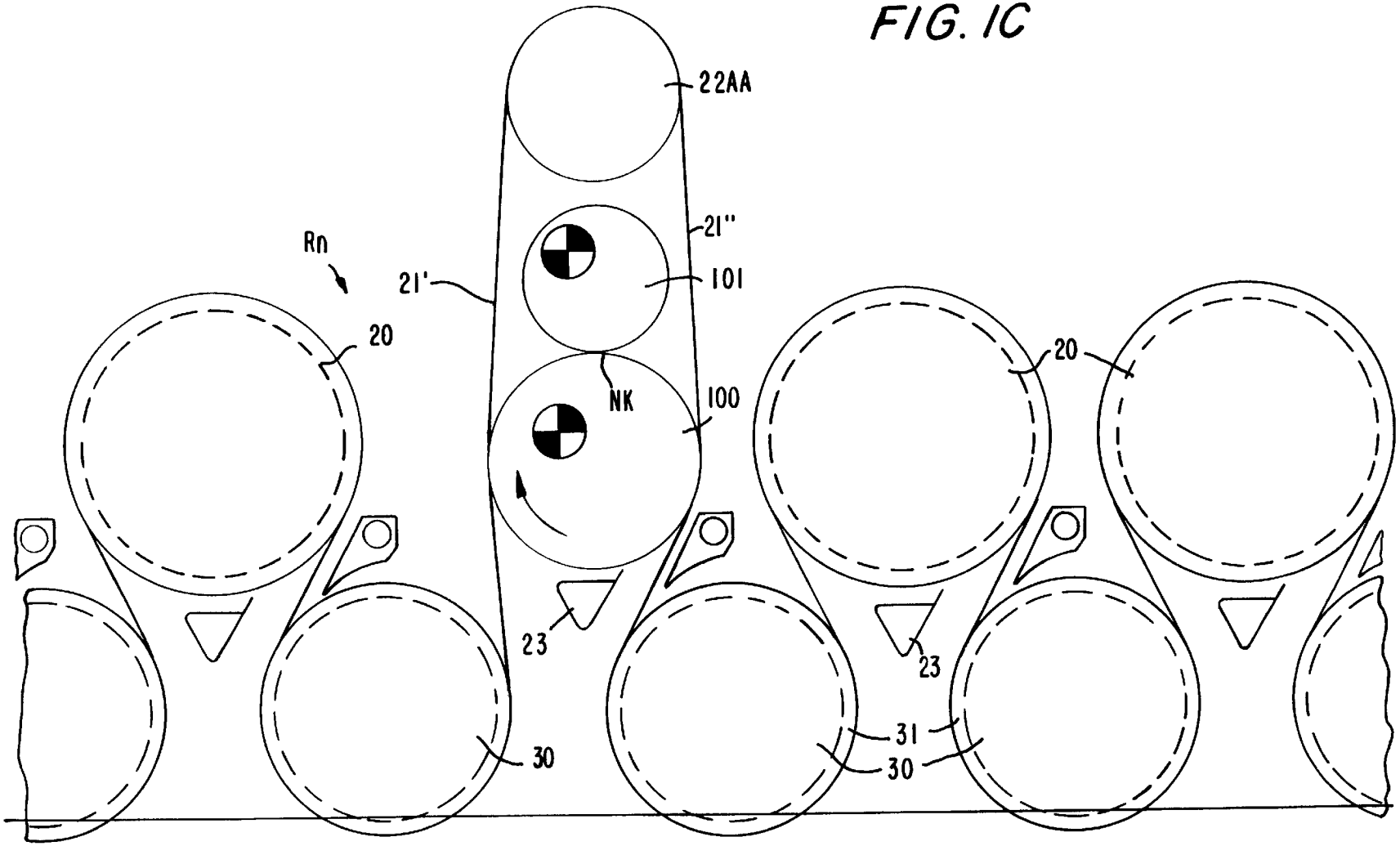
FIG. 1C shows a modification of the embodiment shown in FIG. 1A in which the drying cylinder in the upper row in the normal group with single-wire forming the calendering nip is replaced by a calender roll so that the calendering nip is formed by two calender rolls.

FIG. 1C shows an arrangement of intermediate calendering in which the nip NK of intermediate calendering is arranged inside a group with single-wire draw $R_n$, in a similar manner as in FIG. 1A but is formed by two calender rolls. In order to form the nip NK of intermediate calendering between two calender rolls, one of the drying cylinders 20*a* in the upper row of the normal single-wire draw group is replaced by calender roll 100 and a guide roll 22AA for the drying wire 21 is arranged above the calender roll 100. The drying wire 21 and web may pass together over a portion of the calender roll 100 prior to and after the calendering nip NK. By means of the guide roll 22AA, the drying wire 21 is passed in a pair of straight runs 21' and 21" apart from the calender roll 100 and from the paper web W which remains on the surface of the calender roll 100. Inside the wire runs 21' and 21" and underneath the guide roll 22AA, i.e., between a location at which the drying wire 21 is separated from the web and a location at which the drying wire 21 recontacts the web, an additional calender roll 101 is arranged to form the nip NK of intermediate calendering together with the calender roll 100. In other respects, the construction and the operation of the dryer section of FIG. 1C are similar to those described above in connection with FIG. 1A. Thus, in general, the guide roll 22AA separates the wire from a face of the web at one location and returns the wire into contact with the web at a downstream location whereby in the interim, the web is passed through the calendering nip and calendered.

Figure 2:
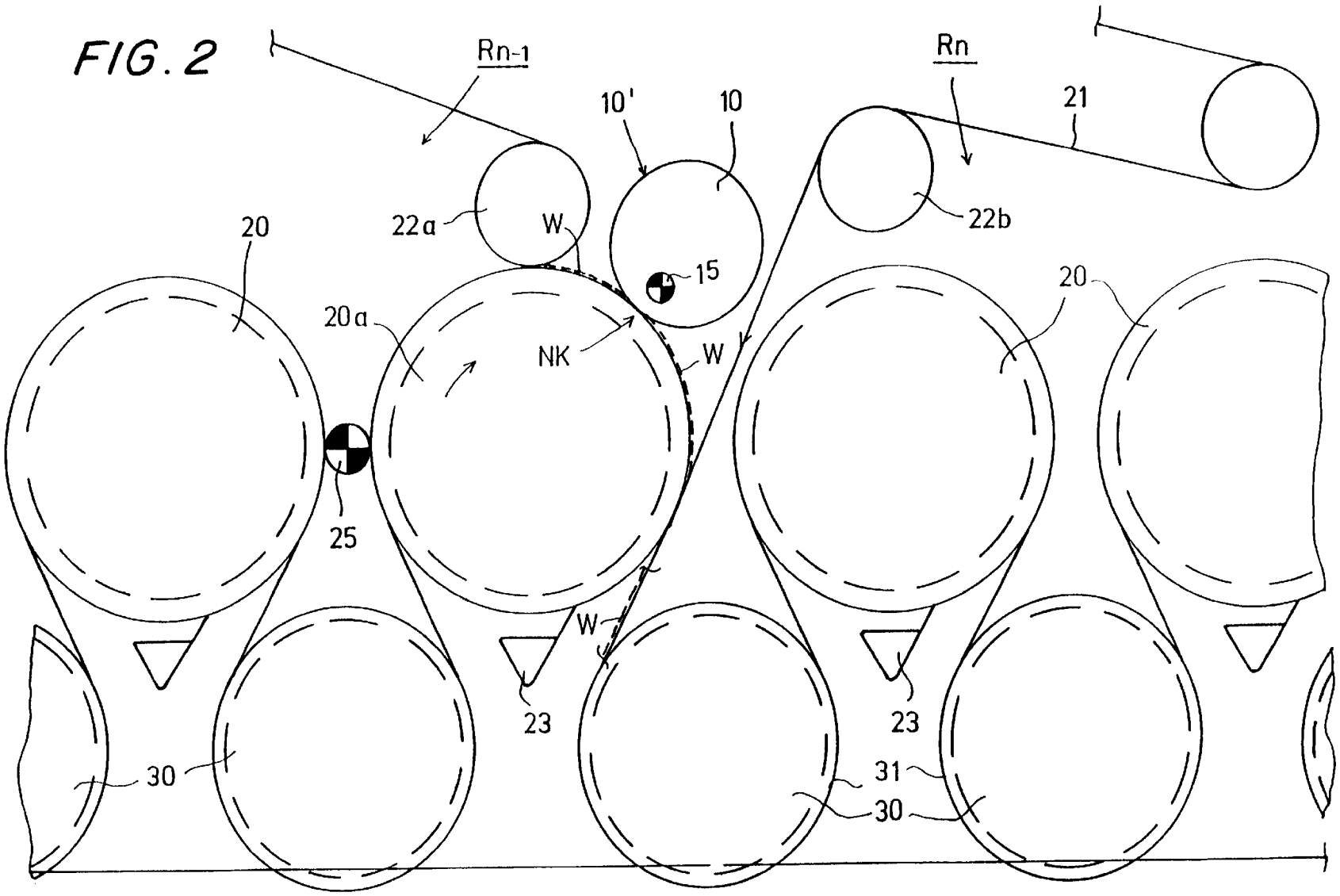
FIG. 2 shows a first embodiment of the dryer section in accordance with the invention in which the breaker stack (intermediate calender) is arranged between two successively arranged groups with single-wire draw.

Instead of, or in addition to, a calendering nip NK as shown in FIGS. 1, 1A, 1B and 1C, it is possible to use a calendering nip NK between the groups $R_n$ and $R_{n-1}$, with single wire draw in accordance with FIG. 2. As shown in FIG. 2, in connection with the last cylinder 20*a* in the preceding group with single-wire draw $R_{n-1}$, the drying wire 21 is guided by a guide roll 22*a*, and the guide roll 22*b* in the latter group $R_n$ is arranged, such that the latter upper quarter of the drying cylinder 20*a* remains free in such a way that an intermediate calender roll 10 can be arranged on this quarter. Roll 10 thus forms a calendering nip NK with the drying cylinder 20*a*. In this manner, the intermediate calendering nip NK can be arranged favorably so that the web W constantly has a closed draw before and after the calendering nip NK, and so that the overall length of the dryer section is not increased at all. In other respects, the construction of the dryer section in FIG. 2 is similar to that described above in relation to FIGS. 1 or 1A.

Figures 2A, 2B:
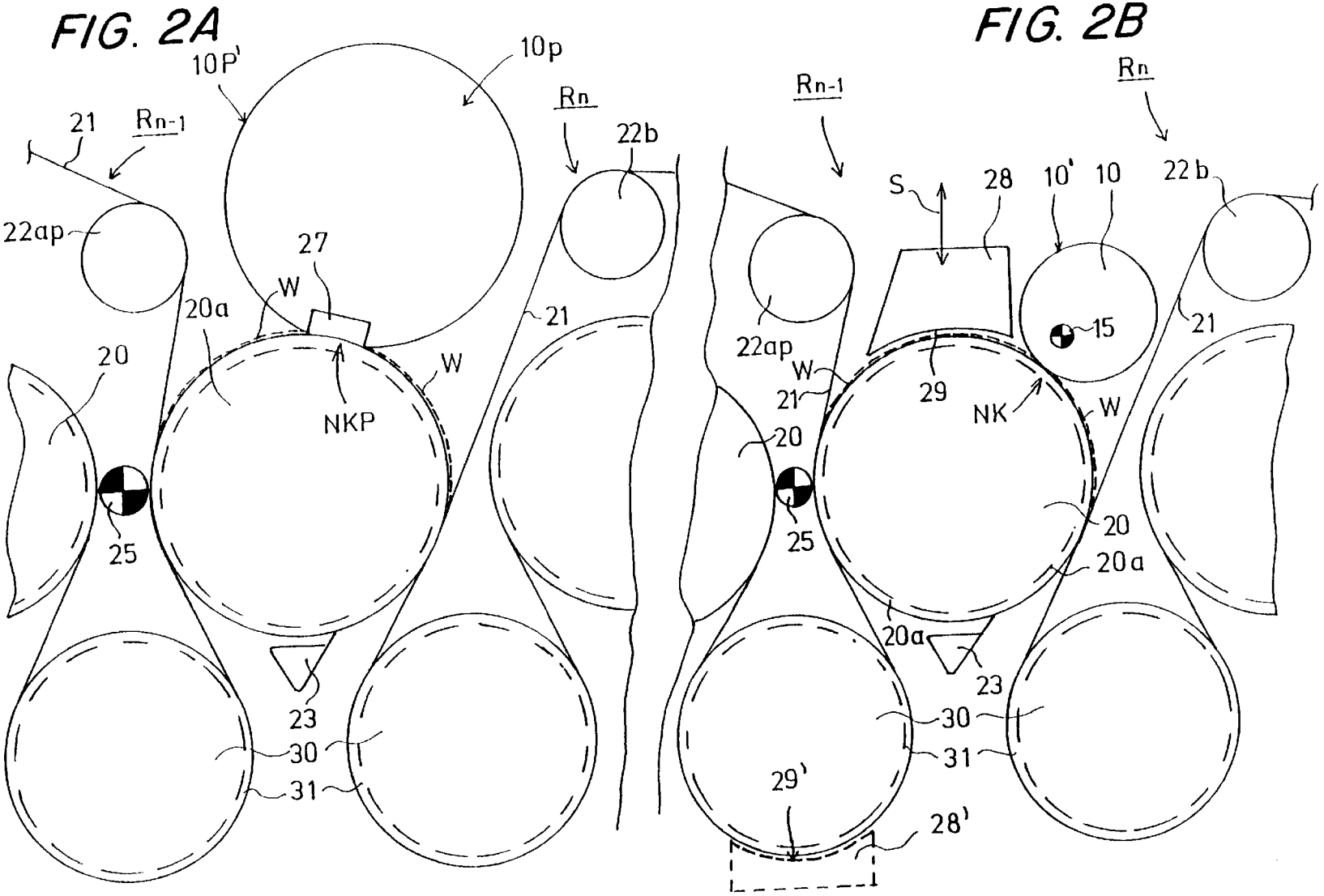
FIG. 2A shows an arrangement of intermediate calendering which is in most respects similar to that shown in FIG. 2, except that in FIG. 2A an extended nip is used as the intermediate calendering nip.
FIG. 2B shows a modification of the arrangement of intermediate calendering shown in FIG. 2 in which the intermediate calendering nip is preceded by a web heating device, such as a steam box, which promotes the calendering effect.

FIG. 2A shows a modification of the arrangement of intermediate calendering shown in FIG. 2 in which the calender roll 10 has been substituted for by an extended-nip roll 1 OP which forms an extended calendering nip NKP with the drying cylinder 20*a*. In a manner in itself known, the extended-nip roll 10P has a flexible hose mantle 10P' which has closed vertical ends at both sides. Inside the hose mantle 10P', there is a hydraulically loaded glide shoe or a series 27 of glide shoes which forms an extended calendering nip NKP with the drying cylinder 20*a*. The length of the calendering nip NKP in the direction of progress of the web W is generally of an order of from about 100 mm to about 300 mm. As the extended-nip roll 10P, for example, an extended-nip roll marketed under the assignee's trademark Sym-Belt™ is used, which roll has been applied previously mainly in press sections of paper machines.

In FIG. 2A, the guide rolls 22*ap* and 22*b* of the drying wires 21 in the groups $R_{n-1}$,$R_n$ are arranged so that a sufficient space remains for the extended-nip roll 10P of relatively large diameter and for its couplings in connection with and above the drying cylinder 20*a*. The diameter of the extended-nip roll IOP is, for example, of the same order as the diameter of the drying cylinders 20,20*a*. When an extended nip NKP is employed, a particularly efficient calendering effect is obtained. Also, when an extended nip NKP is employed, by means of a series 27 of glide shoes, it is possible to control the nip-pressure profile of the calendering zone both in the cross direction and in the machine direction in a manner in itself known.

FIG. 2B shows another modification of the arrangement of intermediate calendering as shown in FIG. 2 in which calendering effect promoting/intensification means are arranged above the drying cylinder 20*a* and before the calendering nip NK. These means such as a particular device 28 are arranged in this position so that by their operation, the calendering effect in the following nip NK is promoted. In order that space could be provided for the device 28 above the cylinder 20*a*, the guide roll 22*ap* of the drying wire 21 is arranged in a position suitable for this purpose. The device 28 is, for example, a steam feed box, an infrared heater, or equivalent web heating means, by whose means the temperature of the web W is raised at the side of its free upper face, whereby the calendering effect is enhanced directly after the device 28 in the nip NK. Moreover, in connection with the device 28, there may be water-mist spray devices or equivalent fluid spray means, by whose means the calendering effect is promoted in the nip NK. If necessary, the device 28 is arranged so that its position with respect to the exposed face of the web can be regulated, which is illustrated schematically by the arrow S. By means of the regulation S, it is possible to affect the extension of the contact-free treatment gap 29 of the device 28 above the web W, i.e., defined between the web and the curved lower face of the device 28, and possibly also the efficiency of the heat treatment. The heating device 28, or possibly an equivalent second heating device, can also be arranged in connection with the face of the calender roll 10 so as to enhance the calendering effect in the nip NK. By means of the devices 28 or equivalent heating measures, it is also possible to control the cross-direction temperature, moisture, and/or linear-load profile in the nip NK and, thus, to contribute to providing the web W with the desired cross-direction profile. FIG. 2B also shows a heating and/or profiling device 28' arranged underneath a reversing suction cylinder 30, which device treats the web W through a contact-free treatment gap 29' from the side of the face opposite in relation to the side of the web effected by the operation of the device 28.

Figure 2C:
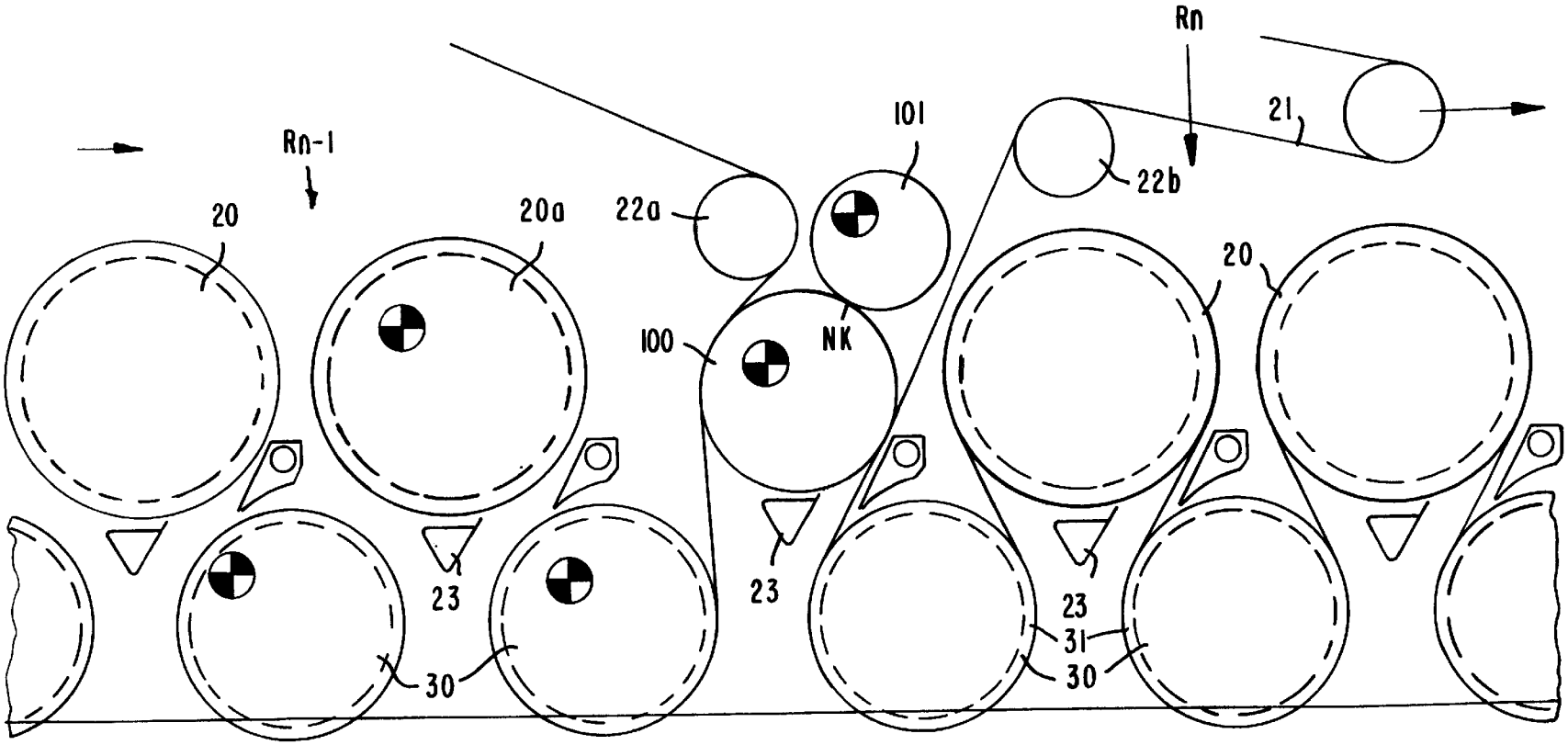
FIG. 2C shows a dryer section similar to that shown in FIG. 2 except that the intermediate calender is not only arranged between two successively arranged groups with single-wire draw but is formed by two calender rolls.

In the embodiment shown in FIG. 2C, after the last reversing suction cylinder 30 in the normal group with single-wire draw $R_{n-1}$, the web is carried by the drying wire 21 onto the surface of a calender roll 100, after which the drying wire 21 separates from the web, to be carried on an outer surface thereof into and through a calendering nip NK. The calendering nip NK is formed by the calender roll 100 and an additional calender roll 101. A doctor 23 may be arranged in connection with calender roll 100 to doctor the outer surface thereof.

Figure 2D:
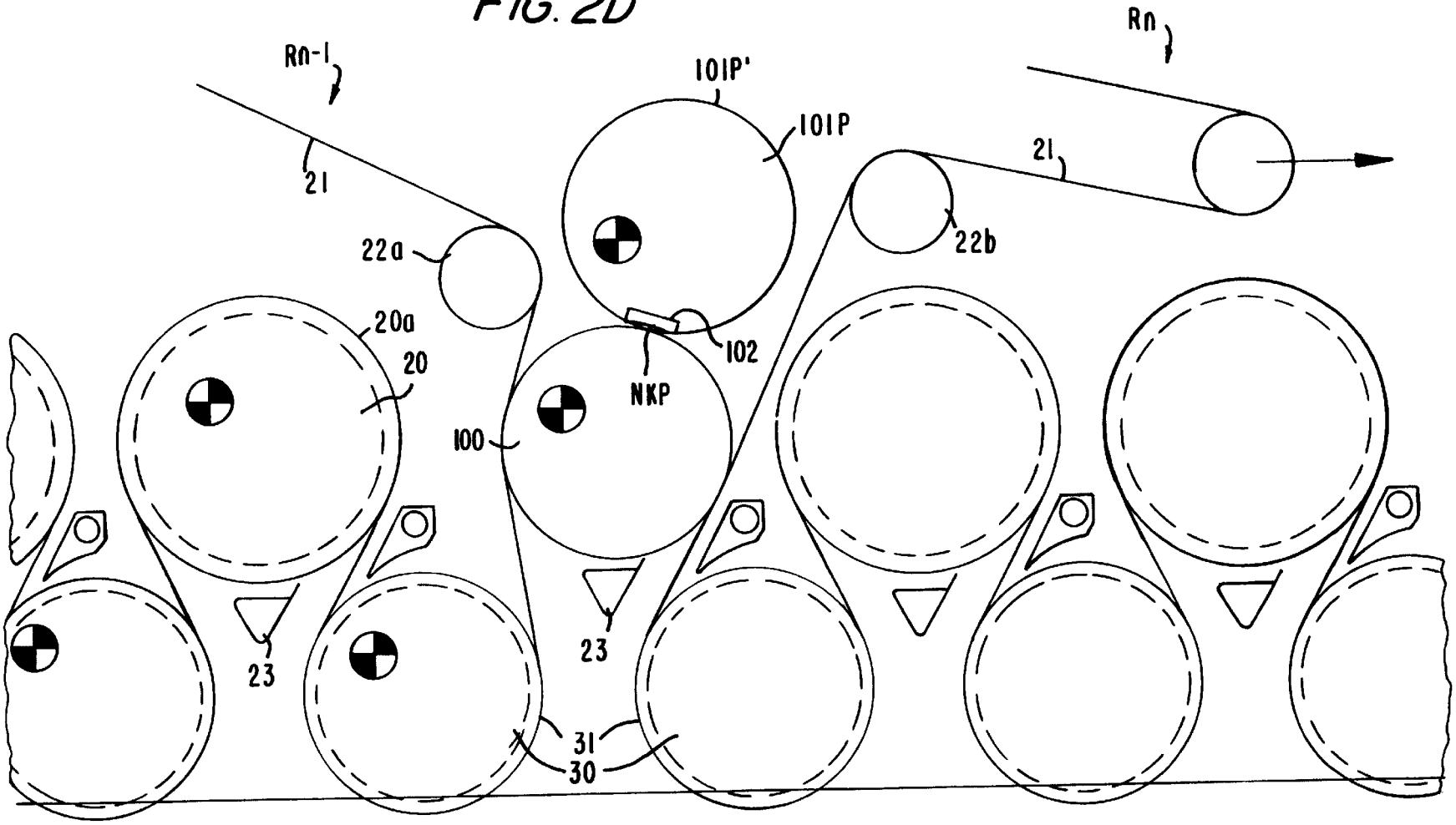
FIG. 2D shows an arrangement of intermediate calendering which is in most respects similar to that shown in FIG. 2C, except that in FIG. 2D an extended nip is used as the intermediate calendering nip.

FIG. 2D shows a modification of the arrangement of intermediate calendering shown in FIG. 2C in which the calender roll 101 has been substituted for by an extended-nip roll 101P which forms an extended calendering nip NKP with the calender roll 100. In a manner in itself known, the extended-nip roll 101P has a flexible hose mantle 101P' which has closed vertical ends at both sides. Inside the hose mantle 101P', there is a hydraulically loaded glide shoe or a series 102 of glide shoes which forms an extended calendering nip NKP with the calender roll 100. The length of the calendering nip NKP in the direction of progress of the web W is generally of an order of from about 100 mm to about 300 mm. As the extended-nip roll 101P, for example, an extended-nip roll marketed under the current assignee's trademark Sym-Belt™ is used, which roll has been applied previously mainly in press sections of paper machines. As in the embodiment shown in FIG. 2A, the guide rolls 22*ap* and 22*b* of the drying wires 21 in the groups $R_{n-1}$,$R_n$ are arranged so that a sufficient space remains for the extended-nip roll 101P of relatively large diameter and for its couplings in connection with and above the calender roll 100. The diameter of the extended-nip roll 101P may be, for example, of the same order as the diameter of the drying cylinders 20,20*a*. When an extended nip NKP is employed, a particularly efficient calendering effect is obtained and by means of the series 102 of glide shoes, it is possible to control the nip-pressure profile of the calendering zone both in the cross direction and in the machine direction in a manner in itself known.

Figure 2E:
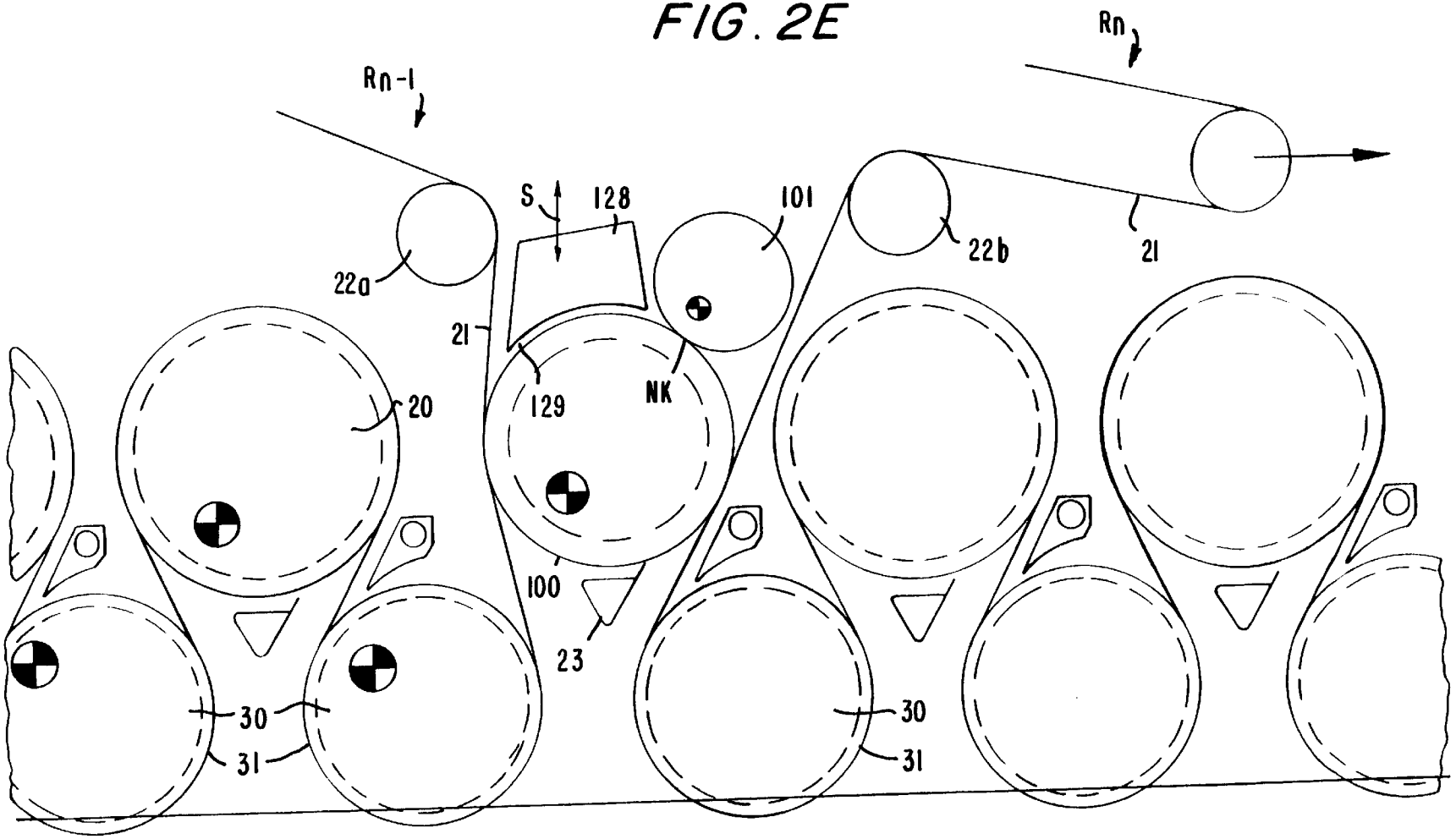
FIG. 2E shows a modification of the arrangement of intermediate calendering shown in FIG. 2C in which the intermediate calendering nip is preceded by a web heating device, such as a steam box, which promotes the calendering effect.

FIG. 2E shows another modification of the arrangement of intermediate calendering as shown in FIG. 2C in which calendering effect promoting/intensification means are arranged above the calender roll 100 and before the calendering nip NK. These means such as a particular device 128 are arranged in this position so that by their operation, the calendering effect in the following nip NK is promoted. In order that space could be provided for the device 128 above the calender roll 100, the guide roll 22*ap* of the drying wire 21 of the preceding normal group with single-wire draw is arranged in a position suitable for this purpose. The device 128 is, for example, a steam feed box, an infrared heater, or equivalent web heating means, by whose means the temperature of the web W is raised at the side of its free upper face, whereby the calendering effect is enhanced directly after the device 128 in the nip NK. Moreover, in connection with the device 128, there may be water-mist spray devices or equivalent fluid spray means, by whose means the calendering effect is promoted in the nip NK. If necessary, the device 128 is arranged so that its position with respect to the exposed face of the web can be regulated, which is illustrated schematically by the arrow S. By means of the regulation S, it is possible to affect the extension of the contact-free treatment gap 129 of the device 128 above the web W, i.e., defined between the web and the curved lower face of the device 128, and possibly also the efficiency of the heat treatment. The heating device 128, or possibly an equivalent second heating device, can also be arranged in connection with the face of the calender roll 101 so as to enhance the calendering effect in the nip NK. By means of the device(s) 128 or equivalent heating apparatus, it is also possible to control the cross-direction temperature, moisture, and/or linear-load profile in the nip NK and thus to contribute to providing the web W with the desired cross-direction profile.

Figure 3:
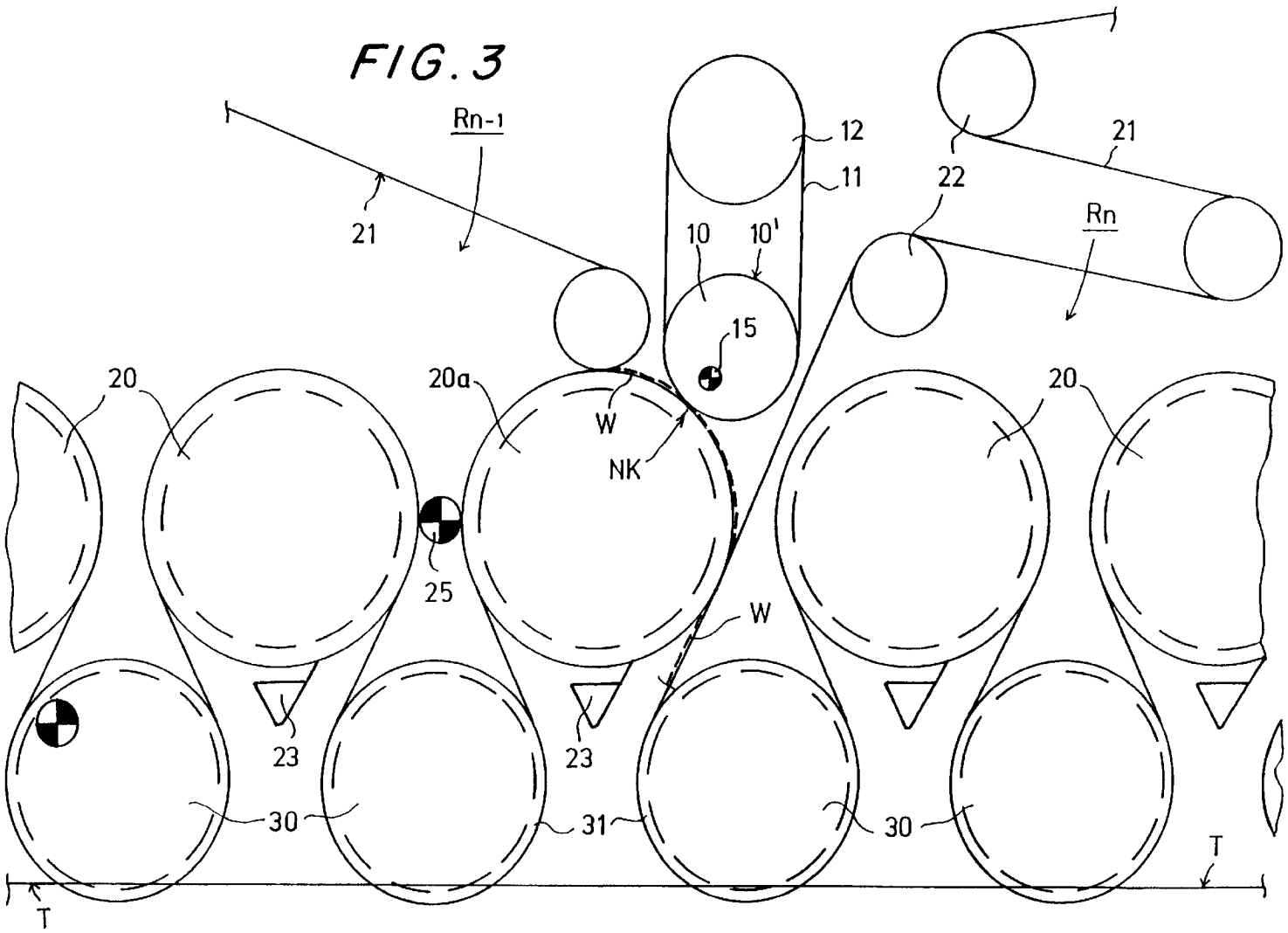
FIG. 3 shows a variation of the embodiment shown in FIG. 2.

FIG. 3 shows a variation of the embodiment of a breaker stack (intermediate calender) shown in FIG. 2. In FIG. 3, the groups $R_{n-1}$, and $R_n$ with single-wire draw are arranged in the way shown in FIG. 2, and a particular calendering belt 11 is arranged to run vertically around the calender roll 10 while guided by a guide roll 12, so that the calendering belt 11 runs through the calendering nip NK into contact with the exposed face of the web. The calender roll 10 and/or the guide roll 12 may be provided with associated drive means, so that, if necessary, in the calendering nip NK, the calendering effect can be enhanced by means of a difference in speed between the web W and the outer face of the belt 11, which effect is in itself known to those skilled in the art. The calendering effect can also be varied by using calendering bands or belts 11 of different compressibilities. A calendering belt 11 may be used in accordance with the invention also in other positions of breaker stacks inside a dryer section. It is characteristic of the belt 11 that it has a smooth face arranged facing the paper. The tendency of paper to follow the belt 11 face is preferably inferior to its tendency to follow the face of a cylinder 10 or calender roll at the nip NK.

Figure 3A:
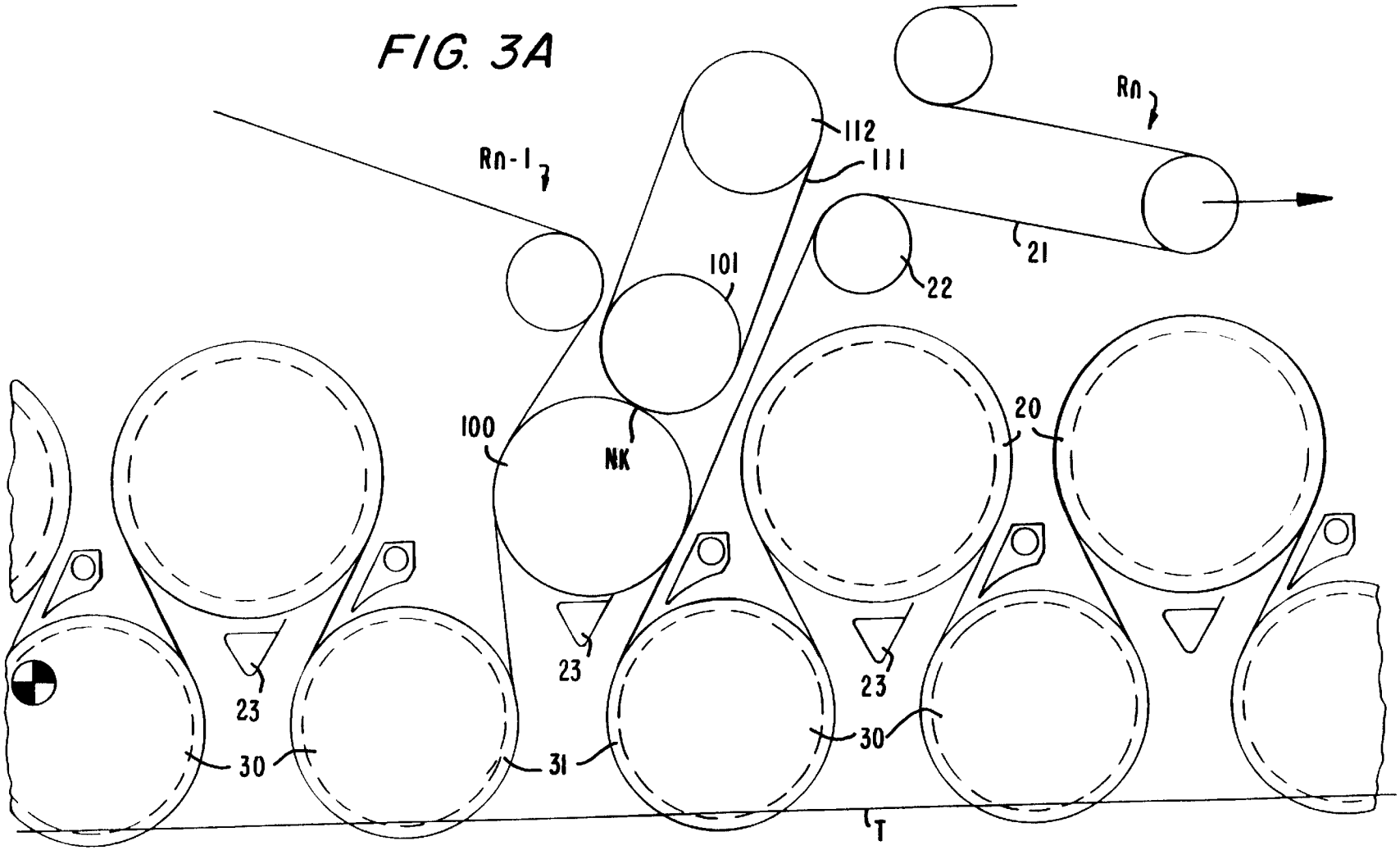
FIG. 3A shows a variation of the embodiment shown in FIG. 2C wherein a calendering belt is used.

FIG. 3A shows a variation of the embodiment of a breaker stack (intermediate calender) shown in FIG. 2C. In FIG. 3A, the groups $R_{n-1}$ and $R_n$ with single-wire draw are arranged in the way shown in FIG. 2C, and a particular calendering belt 111 is arranged to run vertically around the calender roll 101 while guided by a guide roll 112, so that the calendering belt 111 runs through the calendering nip NK into contact with the exposed face of the web. The calender roll 101 and/or the guide roll 112 may be provided with associated drive means, so that, if necessary, in the calendering nip NK, the calendering effect can be enhanced by means of a difference in speed between the web W and the outer face of the belt 111. Some features of a calendering belt are discussed above with respect to the calendering belt 11 of FIG. 3 and are equally applicable here.

In the following, with reference to FIGS. 4 and 5, the second embodiment of the invention will be described.

Figure 4:
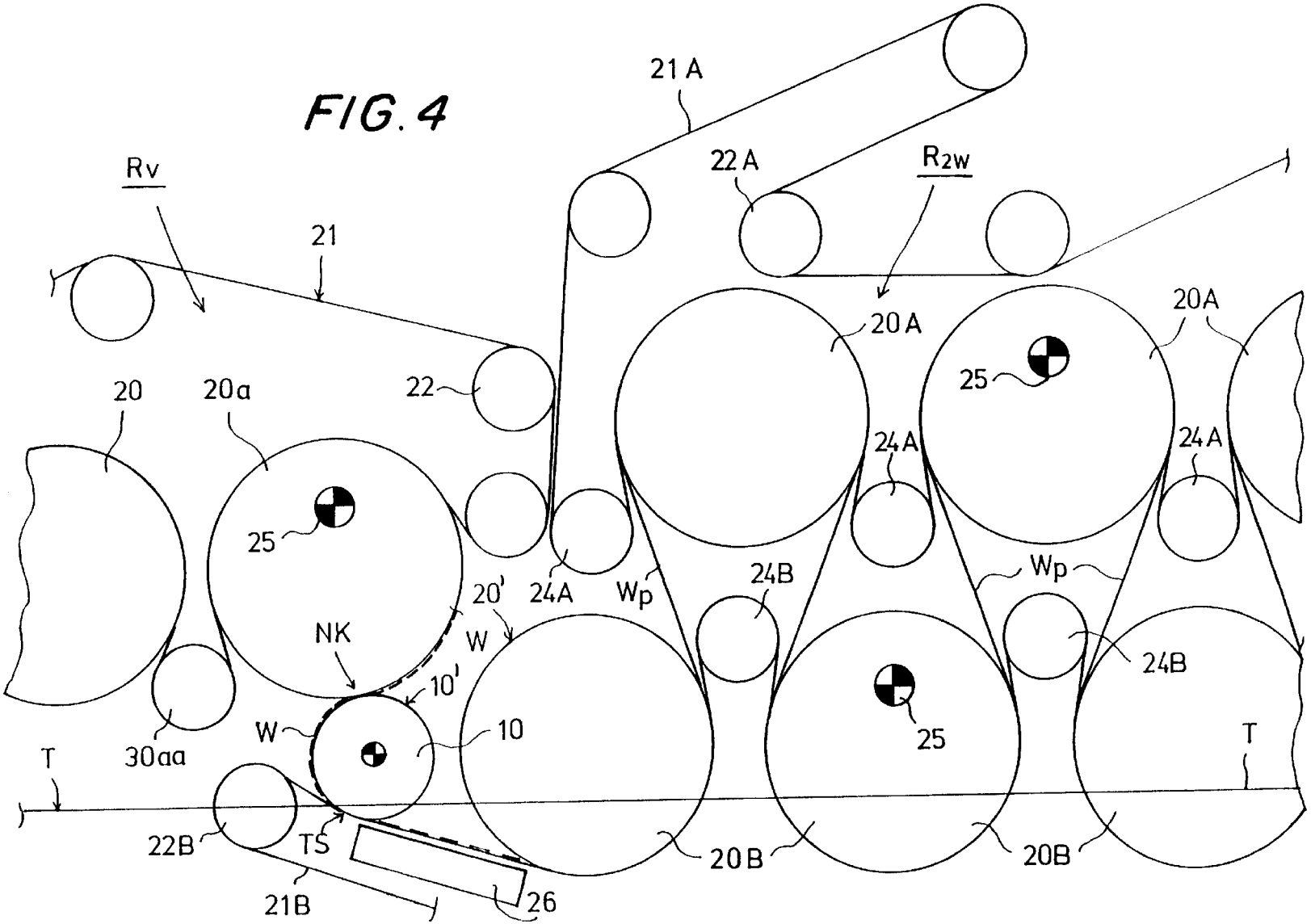
FIG. 4 shows a second embodiment of the dryer section in accordance with the invention, in which the breaker stack (intermediate calender) is arranged at the end of the last group with single-wire draw in the dryer section, which group is further followed by one group with twin-wire draw.

As shown in FIG. 4, the last group with single-wire draw in the dryer section, of which single-wire groups only the group $R_V$ is seen, is followed by one group or, in an exceptional case, by several groups $R_{2W}$ with twin-wire draw. As is well known in the art, the twin-wire group $R_{2W}$ comprises two rows of steam-heated drying cylinders 20A and 20B. In the group $R_{2W}$ there is an upper wire 21A and a lower wire 21B. The upper wire 21A is guided by a set of guide rolls 22A and by a set of guide rolls 24A arranged in the gaps between adjacent ones of the drying cylinders 20A. Similarly, the lower wire 21B is guided by a set of guide rolls 22B and by a set of guide rolls 24B arranged in the gaps between adjacent ones of the drying cylinders 20B. In the group $R_{2W}$, between the rows of cylinders 20A and 20B, the web W has free unsupported draws $W_p$ When the group $R_{2W}$ is arranged in the final end of the dryer section, especially when manufacturing thicker grades of paper, the web W is sufficiently strong to endure the free draws $W_p$ and the fluttering of the web W occurring on such free draws.

According to FIG. 4, the group $R_v$ with single-wire draw preceding the group $R_{2W}$ with twin-wire draw is provided with drying cylinders 20 arranged in an upper row and with small-diameter reversing suction rolls 30*aa* arranged in a lower row below the upper row of drying cylinders 20. In connection with the last drying cylinder 20*a* in the group $R_v$, there is a nip NK for intermediate calendering of the web W to be dried, which nip NK is arranged in accordance with the second embodiment of the invention and which is arranged on the latter lower quarter of the drying cylinder 20*a*. After the calendering nip NK, the web W follows the smooth face 10' of the calender roll 10 over a circumferential segment thereof and is transferred from the roll 10 onto the lower wire 21B of the group $R_{2W}$ with twin-wire draw, which wire is in contact with the latter lower quarter of the calender roll on a small transfer sector TS while guided by its nearby guide roll 22B. In order to guarantee the run of the web, a suction box 26 or other suitable suction or web drawing means is employed. After this, the web W is transferred over the heated face 20' of the first lower cylinder 20B in the group R2W and further, as a free draw $W_{p'}$ onto the first upper cylinder 20A.

Figure 5:
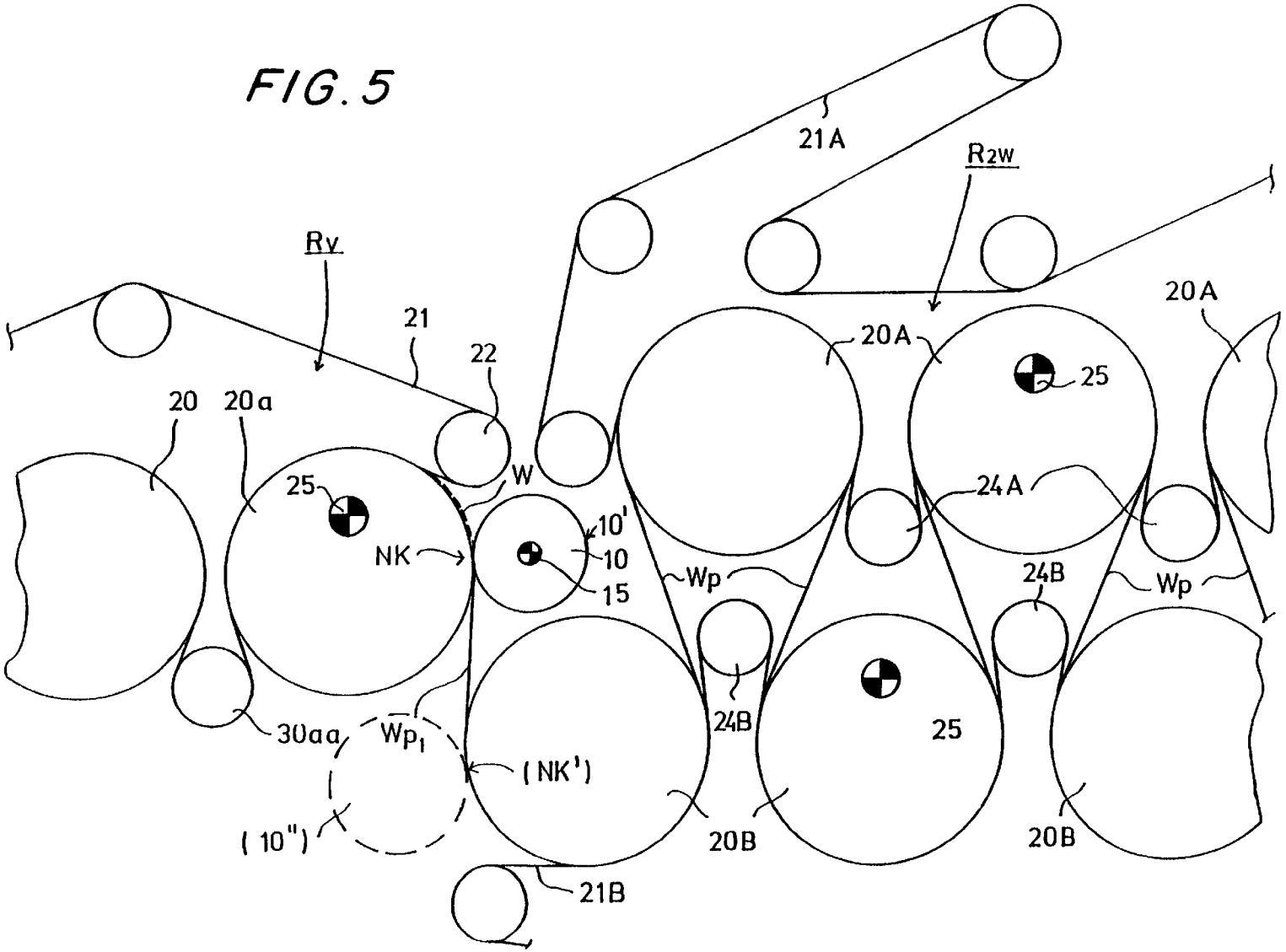
FIG. 5 shows a variation of the second embodiment of the invention shown in FIG. 4.

FIG. 5 shows a modification of the embodiment shown in FIG. 4 in which the intermediate calendering nip NK is arranged in the vicinity of the horizontal plane passing through the center of rotation of the last upper cylinder 20*a* in the last group $R_v$ with single-wire draw so that, after the calendering nip NK, the web W has a downward vertical first free draw $W_{p1}$.

The scope of the present invention also includes an embodiment of the invention shown in FIG. 5 in which, instead of or in addition to the nip NK, a calendering nip NK' is used which is arranged in connection with the first lower cylinder 20B in the group $R_{2W}$ with twin-wire draw and which is formed together with a calender roll 10" (shown in dotted lines).

The embodiments of the invention shown in FIGS. 4 and 5, in particular the embodiment shown in FIG. 5, is best suitable for drying thicker paper grades which can easily endure the free draws $W_{p1}$,$W_p$,. The first draw $W_{p1}$ is, as shown in FIG. 5, already arranged directly after the calendering nip NK.

Figure 5A:
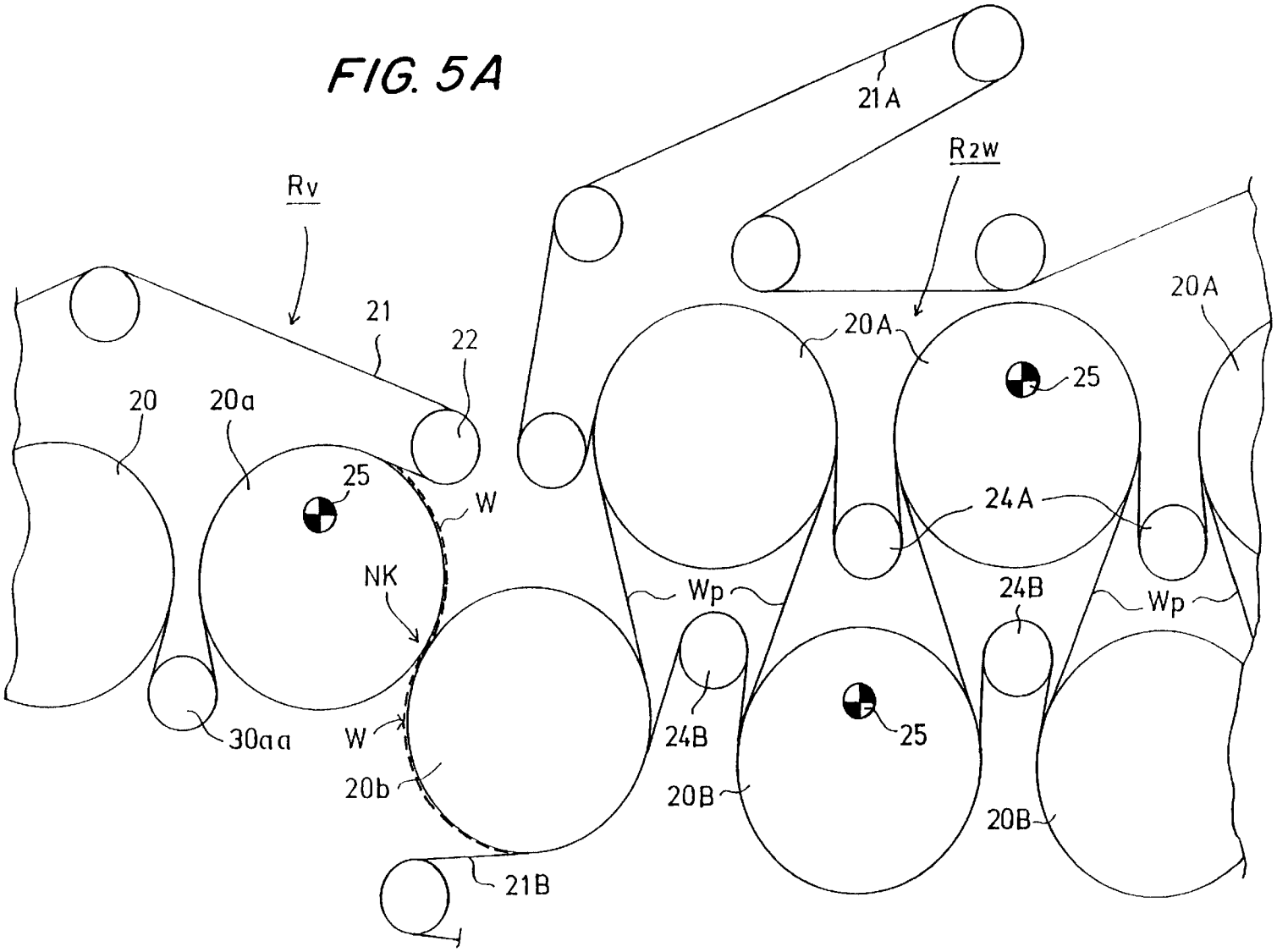
FIG. 5A shows a modification of the embodiment as shown in FIG. 5, which modification is included within the scope of the present invention.

FIG. 5A shows a modification of the embodiment as shown in FIG. 5 in which the last drying cylinder 20*a* in the group R, with single-wire draw and the first drying cylinder 20*b* in the group $R_2$w with twin-wire draw form a nip NK of intermediate calendering with one another. In the position of the drying cylinder 20*a* and/or the drying cylinder 20*b*, instead of a drying cylinder, it is also possible to use a calender roll 10 (as shown in Fig. SB described below). The arrangement of intermediate calendering as shown in FIG. 5A is also favorable in the respect that the construction can be made very compact and an open draw of the web W is avoided in connection with the nip NK of intermediate calendering. The nip NK also serves as a web transfer between the groups.

Figure 5B:
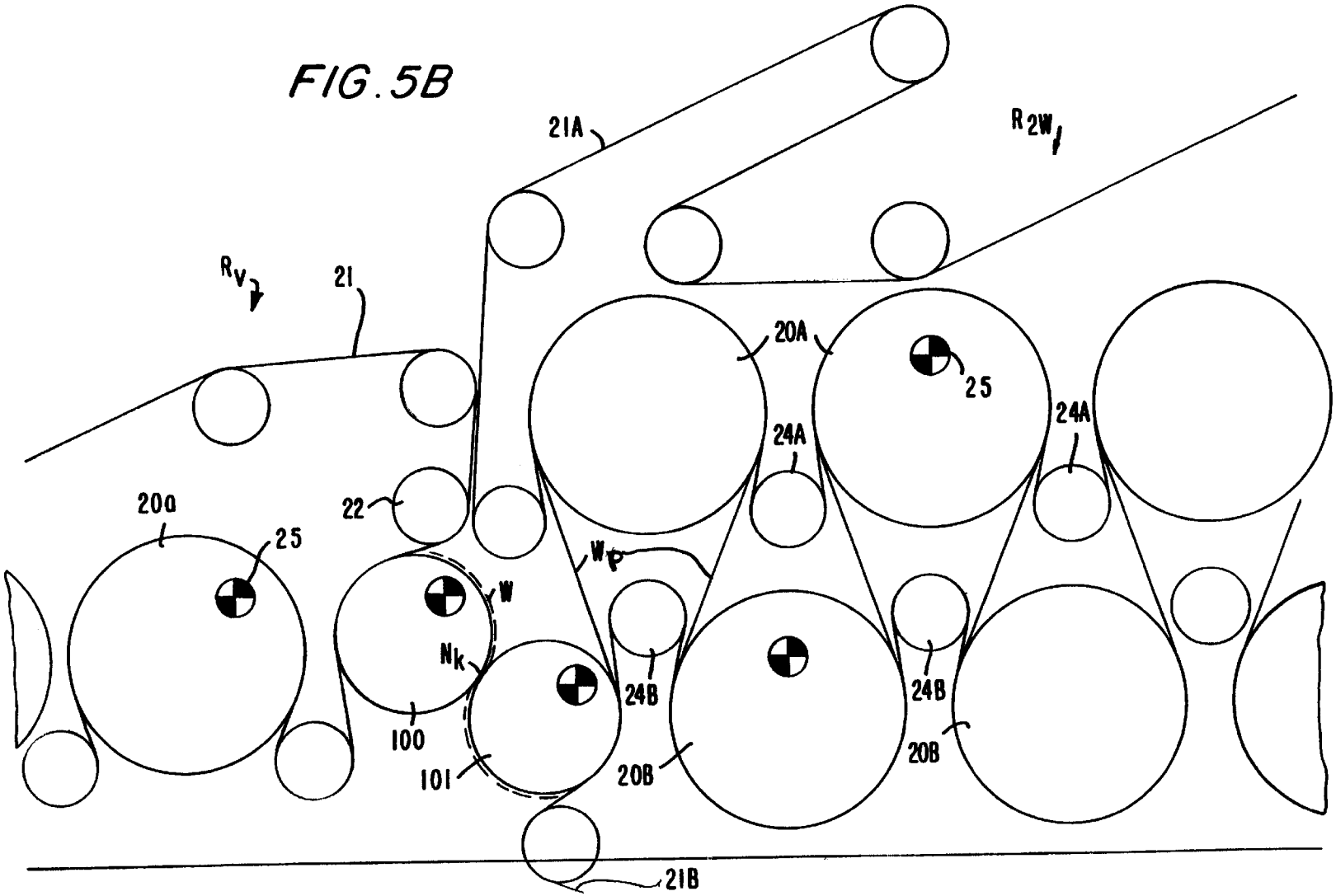
FIG. 5B shows a modification of the embodiment as shown in FIG. 5 in which the calendering nip is formed between two calender rolls.

FIG. 5B shows a modification of the embodiment as shown in FIG. 5A in which, instead of the last drying cylinder 20*a* in the group $R_v$ with single-wire draw and the first drying cylinder 20*b* in the group $R_{2W}$ with twin-wire draw forming a nip NK of intermediate calendering with one another, two calender rolls 100,101 are arranged to form a calender nip NK. The web W is carried onto the surface of the calender roll 100 by the drying wire 21 of the normal single-wire draw group R, which then separates therefrom. The web is carried on the calender roll 100 into and through the calendering nip NK formed between calender rolls 100,101. The drying wire 21B for the lower drying cylinders 20B in the twin-wire draw group $R_{2W}$ contacts the web W about the calender roll 101 and then the web continues through the twin-wire draw group. The arrangement of intermediate calendering as shown in FIG. 5B is also favorable in the respect that the construction can be made very compact and an open draw of the web W is avoided in connection with the nip NK of intermediate calendering.

FIGS. 6, 7, 7A, 7B, 8 and 8A show the third embodiment of the invention, in which the nip NK of intermediate calendering is arranged inside the group $R_{2W}$ with twin-wire draw which may constitute the last group in the dryer section. The dryer section shown in FIGS. 6, 7, 7A, 7B, 8 and 8A is preferably a dryer section in which the group $R_{2W}$ with twin-wire draw is arranged as the last drying group and this group $R_2$W is preceded by a number of normal groups $R_1$, . . . ,$R_v$ with single-wire draw open towards the bottom. The number of such normal groups in a dryer section is typically from 2 to 8. In FIG. 8B, a modification of the third embodiment of the invention is shown in which two nips NK1 and NK2 of intermediate calendering are arranged between a group with single-wire draw and the group with twin-wire draw.

Figure 6:
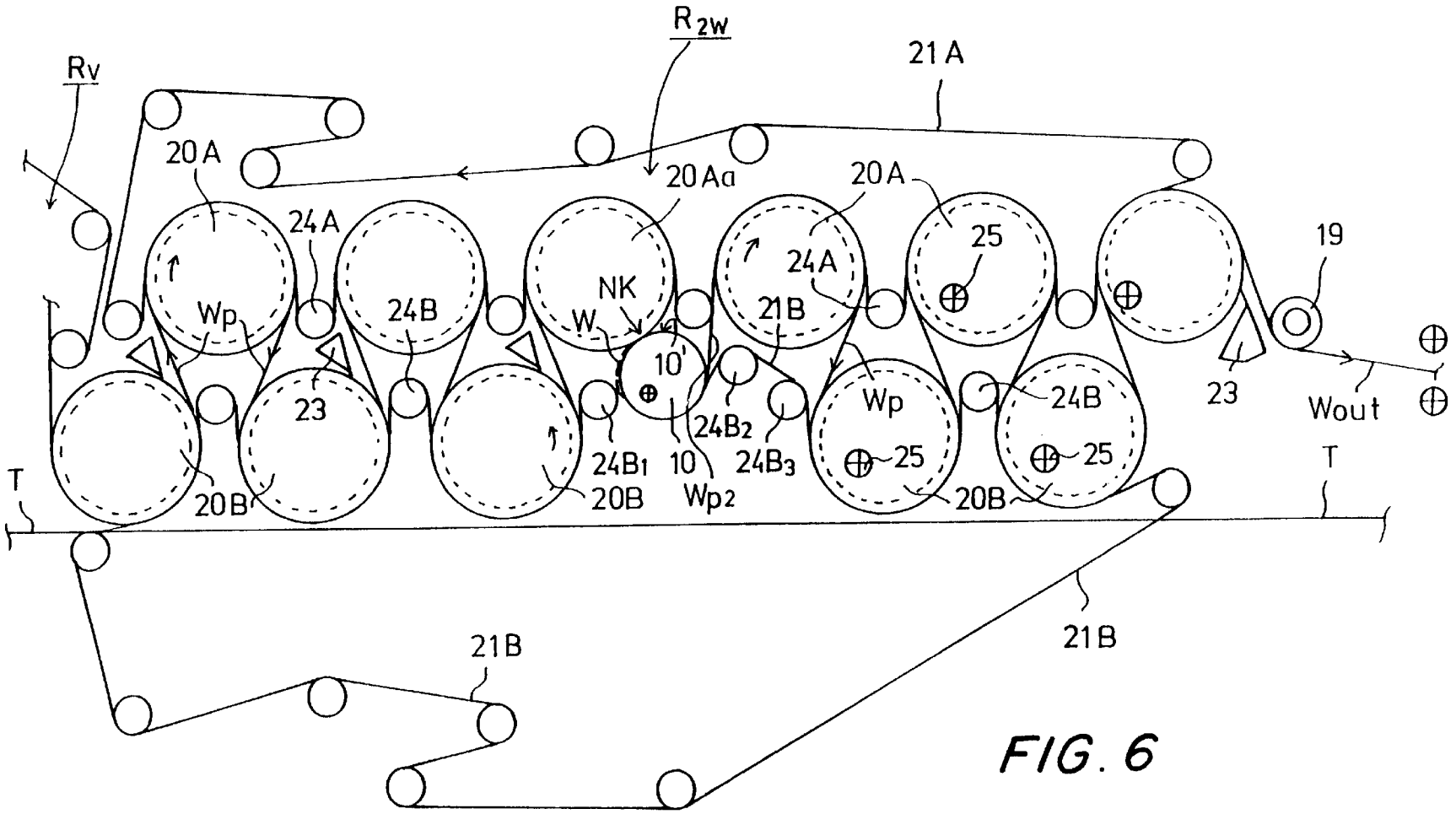
FIG. 6 shows a third embodiment of the dryer section in accordance with the invention, in which the breaker stack (intermediate calender) is arranged inside the group with twin-wire draw which constitutes the last drying group in the dryer section.

As shown in FIG. 6, in the group $R_{2W}$ with twin-wire draw, the fourth lower cylinder 20B has been omitted, i.e., that lower cylinder which would normally be positioned after the third lower cylinder in the running direction of the web, and replaced by a nip NK of intermediate calendering. The calendering nip NK is formed between the third upper cylinder 20A*a* in the group $R_{2W}$ and the calender roll 10. The web W enters into the calendering nip NK on the smooth face of the upper cylinder 20A*a*, from which the web W is transferred to the smooth face 10' of the calender roll 10. After running over a circumferential segment of the calender roll 10, the lower wire 21B receives and supports the web W from below on the portion of the run between the guide rolls 24B1 and 24B2 of the lower wire 21B. After the calender roll 10, the web W has a vertical free draw $W_{p2}$ in its run to the next upper cylinder 20A. After the guide roll 24B2, the drying wire 21B has a downwardly inclined run onto its next guide roll 24B3, which is in a normal position, i.e., in a position corresponding to the other guide rolls 24B of the lower wire 21B in the direction of height and in relation to the adjacent lower cylinder 20B. The operation of the intermediate calender is not changed even if the web were arranged to run in the opposite direction, i.e., the free gap may be arranged before the intermediate calender, which is also applicable to the embodiment shown in FIG. 7.

Figure 7:
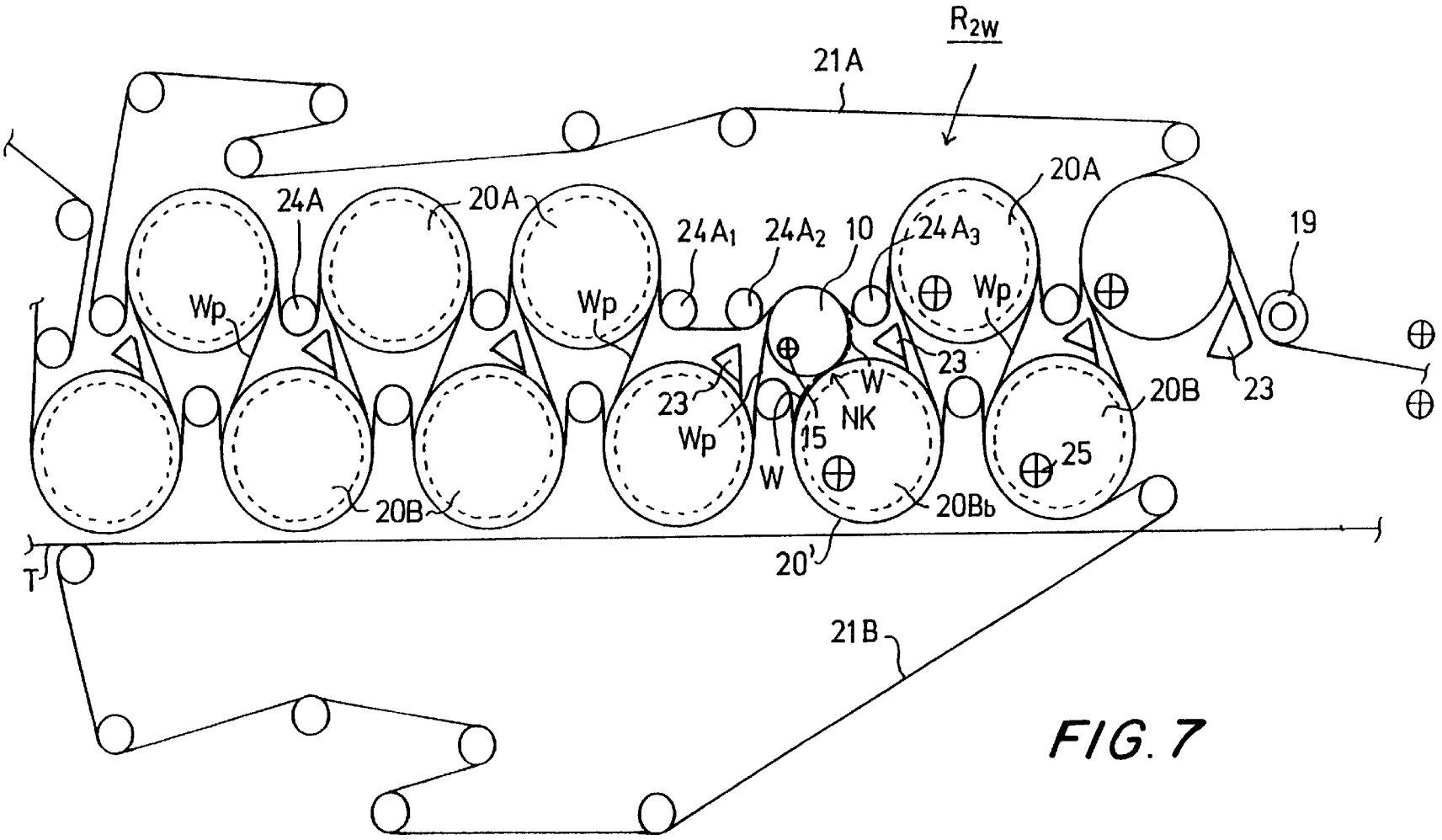
FIG. 7 shows a variation of the third embodiment of the invention shown in FIG. 6.

A second variation of the third embodiment of the invention, shown in FIG. 7, is in other respects substantially similar to that shown in FIG. 6 except that the calendering nip NK is formed in connection with the fifth lower cylinder 20B*b*. In the group $R_{2W}$, the fourth upper drying cylinder 20A has been omitted, i.e., that upper cylinder which would normally be positioned after the third upper cylinder in the running direction of the web, and is substituted for by the calender roll 10, which forms a calendering nip NK with the lower cylinder 20B*b*. The upper wire 21A is guided between its guide rolls 24A1 and 24A3, which are in normal positions, while guided by the guide roll 24A2 and by the calender roll 10, so that the web W arrives on the calender roll 10 after a free draw $W_p$. The web is kept pressed on the calender roll 10 by the upper wire 21 A. After the upper wire 21A is separated from the roll 10 and from the web W in its run to the guide roll 24A3, the web W is passed along the outer face of the calender roll 10 through the calendering nip NK, transferring in the calendering nip NK and further passed on the smooth face 20' of the lower cylinder 20B*b* to be carried in connection with the lower wire 21B. In other respects, the construction is similar to that shown in FIG. 6.

Figure 7A:
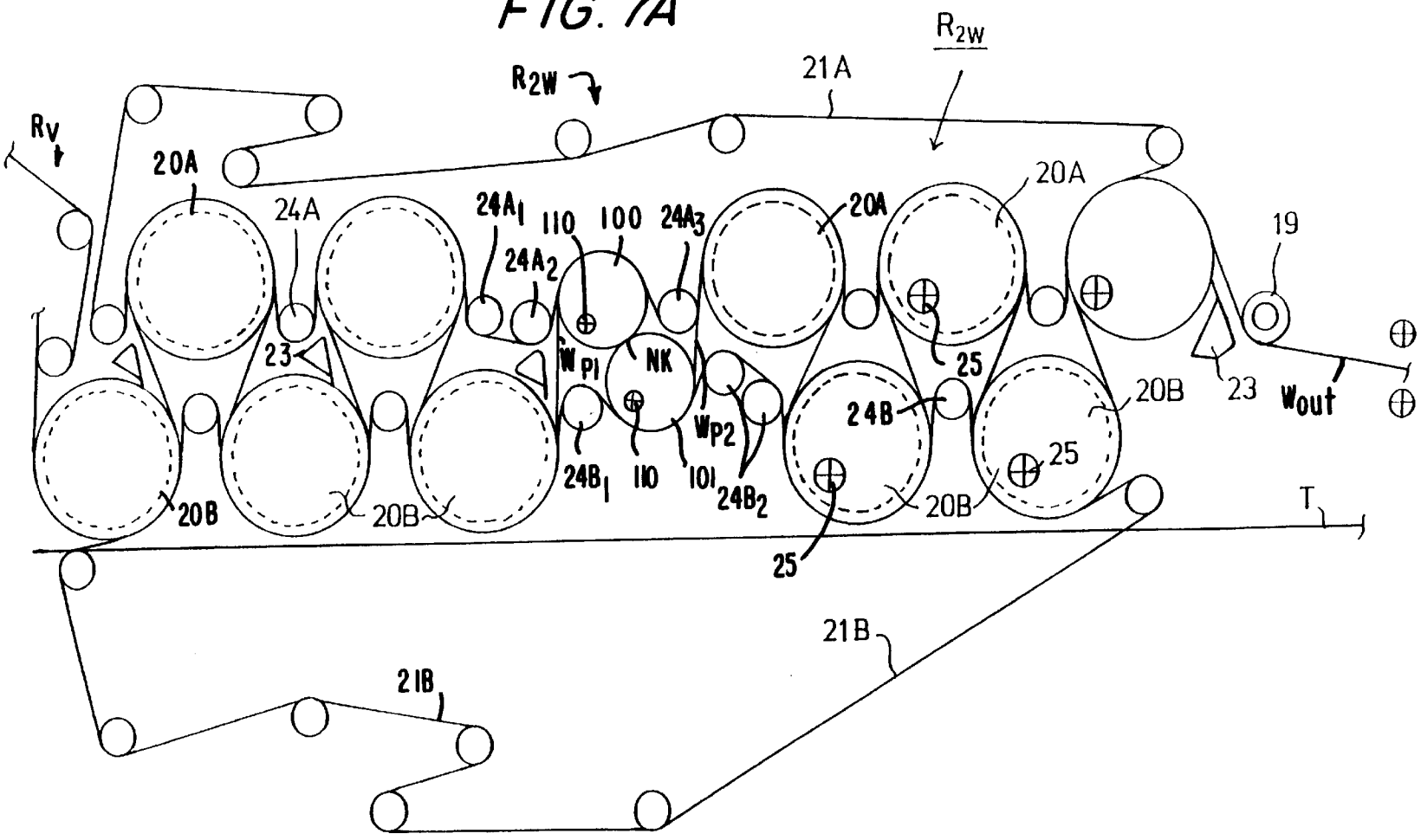
FIG. 7A shows another variation of the embodiment of the invention shown in FIG. 6 in which a calendering nip is formed between two calender rolls in a twin-wire draw group of a dryer section.

As shown in FIG. 7A, in the group $R_{2W}$ with twin-wire draw, the fourth lower cylinder 20B has been omitted, i.e., that lower cylinder which would normally be positioned after the third lower cylinder in the running direction of the web, and replaced by a calender roll 101 and the third upper drying cylinder 20A has been omitted, i.e., that upper cylinder which would normally be positioned after the third upper cylinder in the running direction of the web, and replaced by a calender roll 100 which forms a nip NK of intermediate calendering with calender roll 101. The upper wire 21A is guided between its guide rolls 24A1 and 24A3, which are in normal positions, while guided by the guide roll 24A2 and by the calender roll 100, so that the web W arrives on the calender roll 100 after a free draw $W_{p1}$, from the third lower drying cylinder 20B. The web is kept pressed on the calender roll 100 by the upper wire 21A. After the upper wire 21A is separated from the calender roll 100 and from the web W in its run to the guide roll 24A3, the web W is passed along the outer face of the calender roll 100 through the calendering nip NK, transferred in the calendering nip NK and further passed on the face of the calender roll 101 to be carried in connection with the lower wire 21B. After the web runs over a circumferential segment of the calender roll 101, the lower wire 21B receives and supports the web W from below on the portion of the run between the guide rolls 24B1 and 24B2 of the lower wire 21B. After the calender roll 101, the web W has a vertical free draw $W_{p2}$ in its run to the next upper cylinder 20A. After the guide roll 24B2, the drying wire 21B has a downwardly inclined run onto its next guide roll 24B3, which is in a normal position, i.e., in a position corresponding to the other guide rolls 24B of the lower wire 21B in the direction of height and in relation to the adjacent lower cylinder 20B.

Figure 7B:
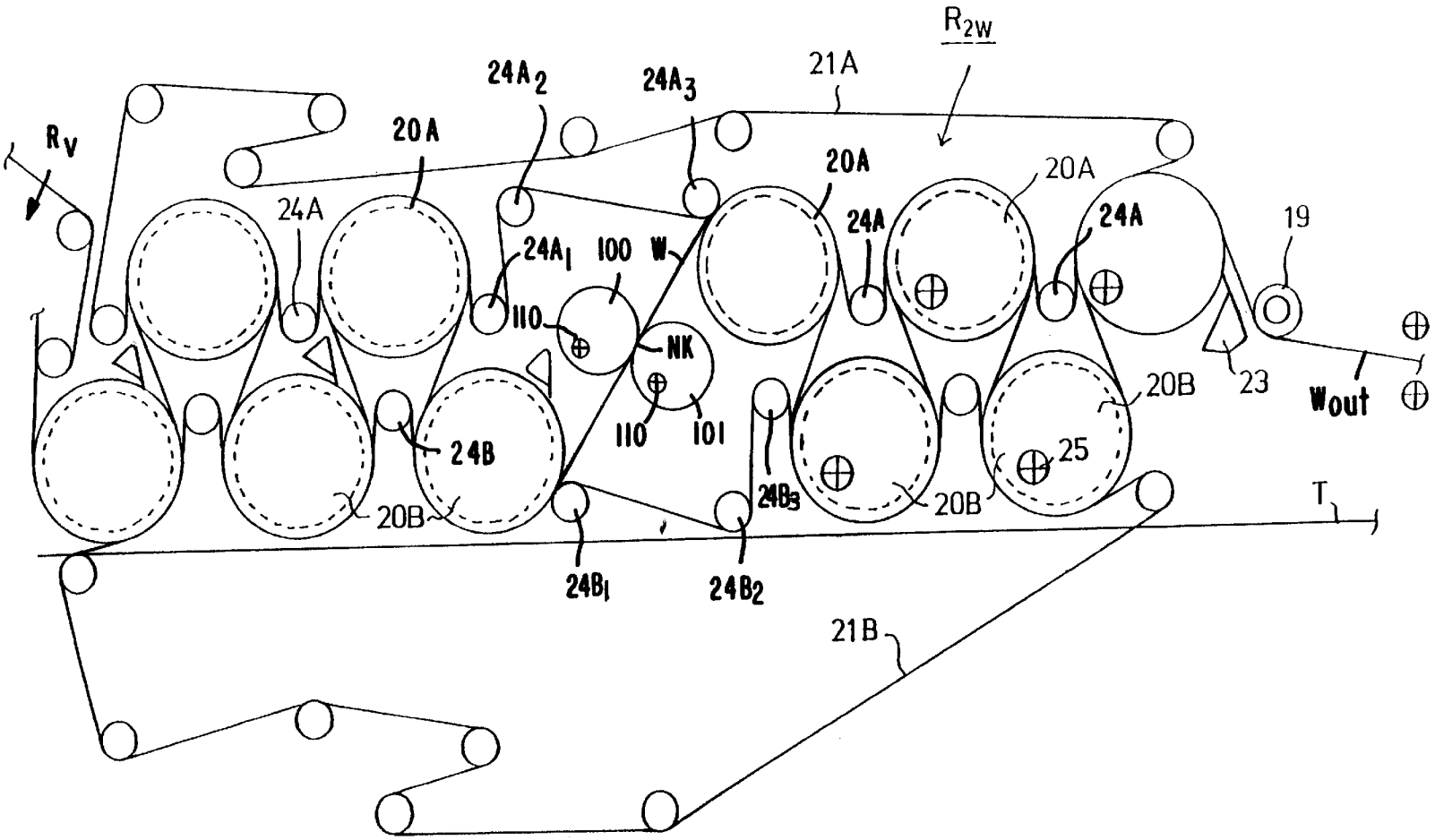
FIG. 7B shows another variation of the embodiment of the invention shown in FIG. 6 in which a calendering nip is formed between two calender rolls in a twin-wire draw group of a dryer section.

As shown in FIG. 7B, a space is formed in the twin-wire draw group between two of the upper drying cylinders 20A and two of the lower drying cylinders 20B and a calendering nip NK is situated therein. More specifically, calender rolls 100,101 are arranged in nip-defining relationship so that the web is passed from a lower drying cylinder 20B arranged before the space to an upper drying cylinder 20A arranged after the space through the calendering nip NK. The position of the guide rolls 24A1, 24A2, 24A3, 24B1, 24B2 and 24B3 is selected to facilitate the path of the web in this manner. More particularly, the guide roll 24B1 of the lower wire 21B removes the same from contact with the web about or immediately after the third drying cylinder 20B and the guide roll 24A3 of the upper wire 21A causes engagement thereof with the web about or immediately before the third drying cylinder 20A after the calendering nip NK. In this manner, the web passes from the third drying cylinder 20B in the lower row through the calendering nip NK to the third drying cylinder 20A in the upper row without contacting the drying wire 21B after it separated therefrom (in contrast to the embodiment in FIG. 7A wherein the lower wire 21B wraps the web about the calender roll 101).

Figure 8:
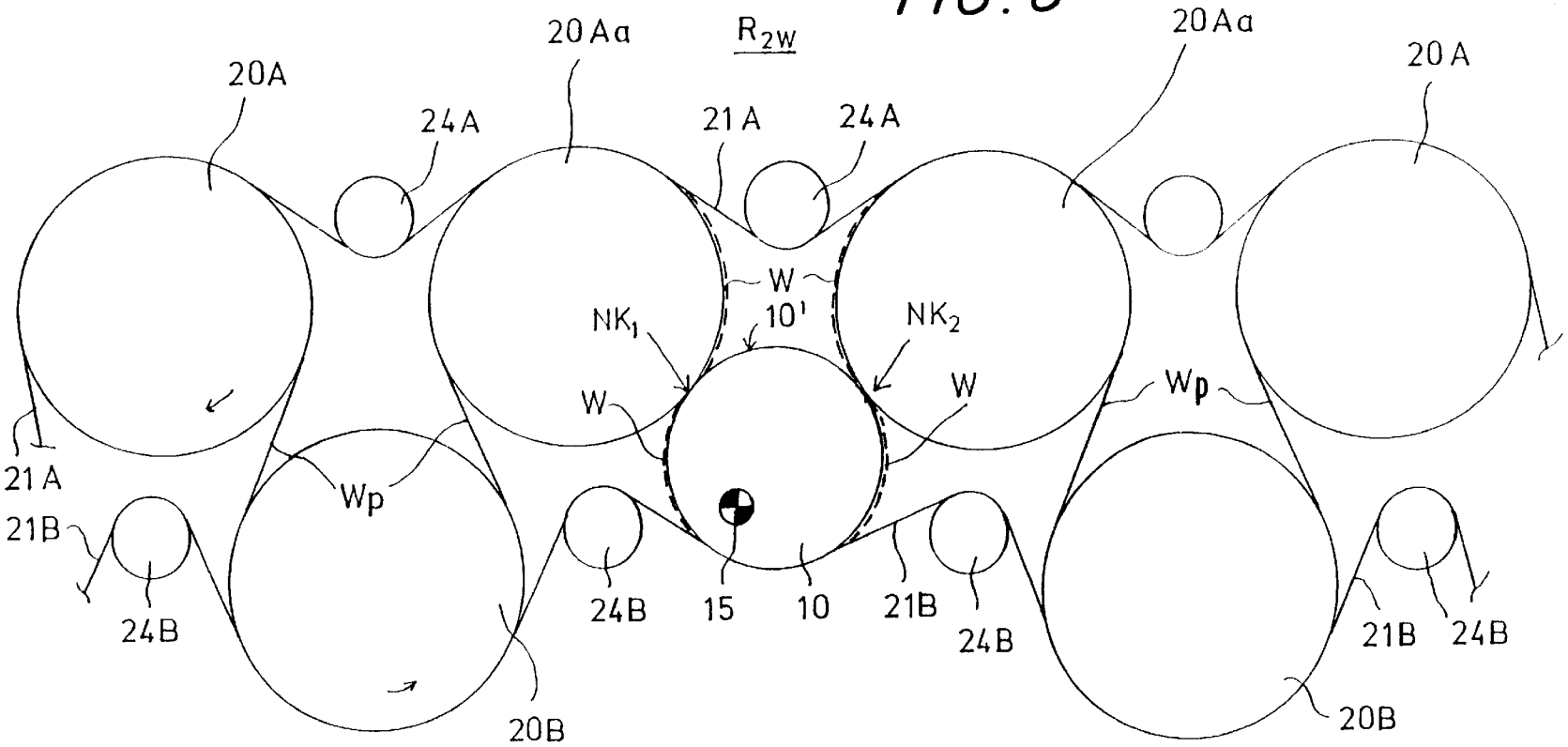
FIG. 8 shows another variation of the third embodiment of the invention shown in FIG. 6.

FIG. 8 shows a third variation of the third embodiment of the invention shown in FIG. 6. According to FIG. 8, the calender roll 10 is provided with a mechanical rotation drive gear 15 or other suitable drive means and forms two calendering nips NK1 and NK2 with two successively arranged drying cylinders 20A arranged above the calender roll 10. After the first nip NK1, the paper web W follows along and is carried by the face of the calender roll 10. On the lower circumference of the calender roll 10, the web W is supported by engagement with the lower wire 21B of the group $R_{2W}$ with twin-wire draw, after which the web W is separated from the lower wire 21B and follows the smooth face 10' of the calender roll 10 into the second calendering nip NK2 formed by the calender roll 10. In accordance with FIG. 8, an arrangement of intermediate calendering of particularly favorable and compact utilization of space and an efficient intermediate calendering are achieved, because two successive calendering nips NK1 and NK2 are employed.

Figure 8A:
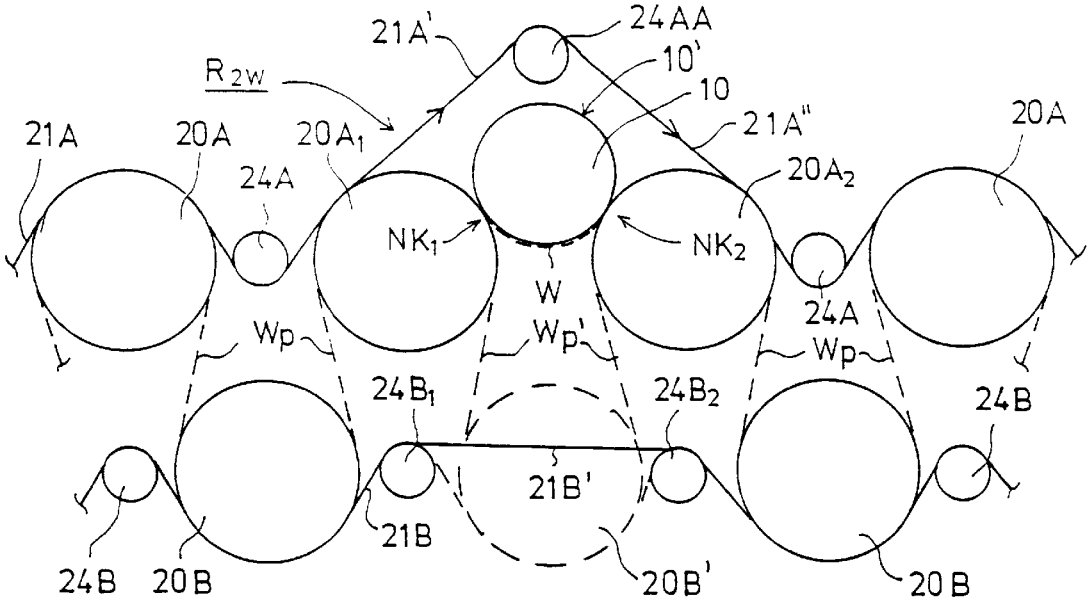
FIG. 8A shows a modification of the arrangement of intermediate calendering shown in FIG. 8, which modification is included within the scope of the invention.
Figure 8B:
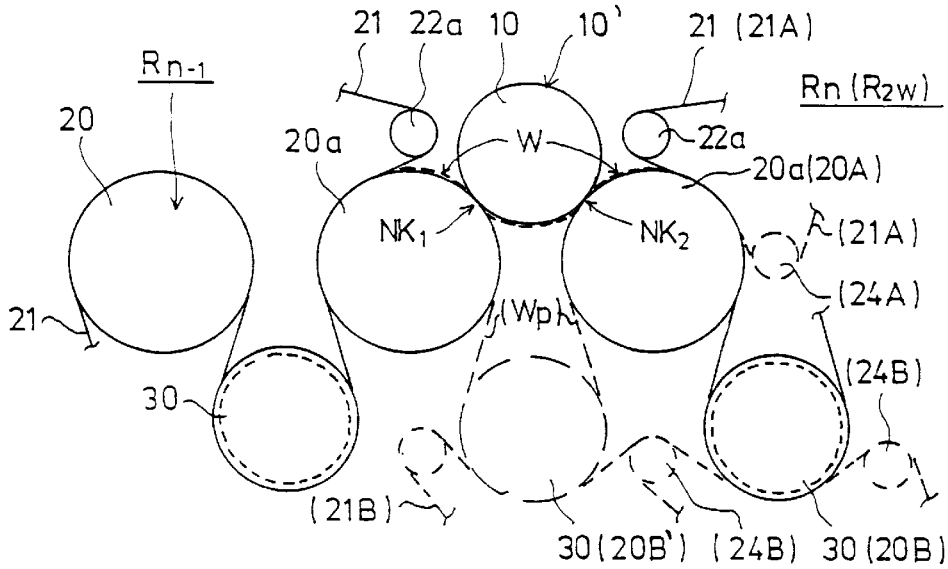
FIG. 8B shows a modification, included within the scope of the invention, of the arrangement of intermediate calendering as shown in FIGS. 8A and 9.

In FIG. 8A, a modification of the embodiment shown in FIG. 8 is shown in which the two successively arranged calendering nips NK1 and NK2 are formed in connection with two successively arranged upper drying cylinders 20A1 and 20A2 while a calender roll 10 is employed which is arranged above the level of the upper drying cylinders 20A,20A1, 20A2. Space has been prepared for the calender roll 10 by passing the upper wire 21A by means of a roll 24AA arranged above the calender roll 10 as a straight run 21A' from the drying cylinder 21A1 onto the guide roll 24AA and from there further as a downwardly inclined run 21A" onto the last drying cylinder 20A2. In view of passing the web W between the calendering nips NK1 and NK2, two alternative embodiments are shown in FIG. 8A. In the first embodiment, the web W is passed from the first nip NK1 into the second nip NK2 on the smooth face 10' of the calender roll 10. In such a case, the lower wire 21B is passed as a horizontal run 21B' from the guide roll 24B1 onto the next, following guide roll 24B2. In an alternative embodiment, the web W is passed as a free draw $W'_p$ onto the lower cylinder 20B' and from it further, as a second free draw $W'_p$, into the second nip NK2.

As shown in FIG. 8B, two successive calendering nips NK1 and NK2 are arranged in connection with the last drying cylinder 20*a* in the former group $R_{n-1}$ with single-wire draw and the first drying cylinder 20*a* in the latter group $R_n$ with single-wire draw by using a calender roll 10 arranged above the row of the drying cylinders 20,20*a*. In FIG. 8B, an alternative is shown by means of dashed lines and reference numerals in brackets in which two successive nips NK1 and NK2 of intermediate calendering are used between a group $R_{n-1}$ with single-wire draw and a group $R_{2W}$ with twin-wire draw. In such a case, the web W can be passed from the first nip NK1 into the second nip NK2 either on the smooth face 10' of the calender roll 10 or by using free gaps (WP) and a drying cylinder that is shown as the first lower cylinder in the position (20B') in the group ($R_{2W}$) with twin-wire draw. When a group ($R_{2W}$) with twin-wire draw is applied, it includes, in a way in itself known, an upper wire (21A) with its guide rolls (24A) and a lower wire (21B) with its guide rolls (24B) as well as lower drying cylinders (20B,20B').

Figure 9:
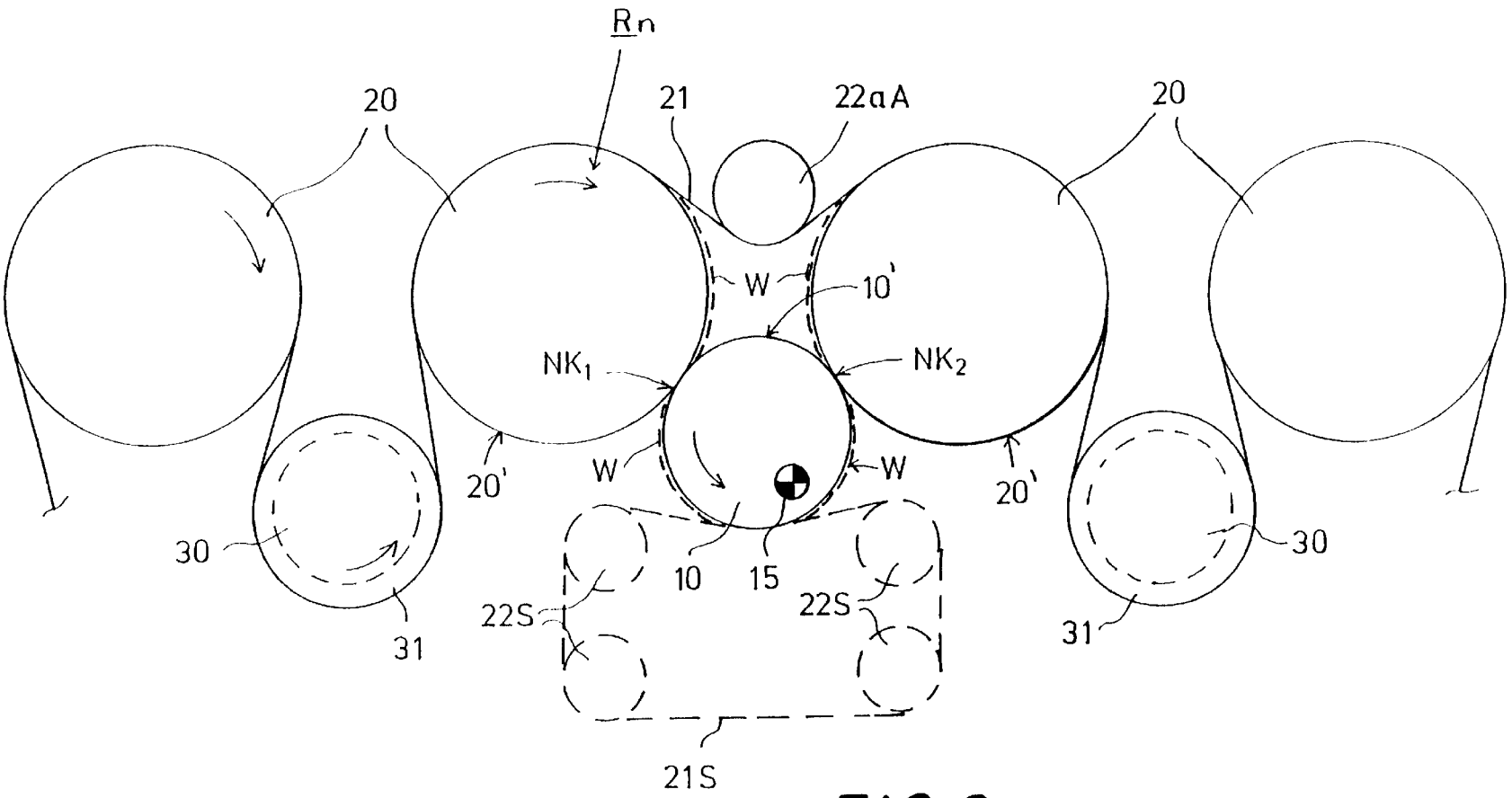
FIG. 9 shows a fourth embodiment of the dryer section in accordance with the invention.

FIG. 9 shows the fourth embodiment, which has certain similarities with the embodiment shown in FIG. 8 in the respect that two calendering nips NK1 and NK2 are used, which nips are formed by one calender roll 10 together with successively arranged upper drying cylinders 20 in a group $R_n$ with single-wire draw. According to FIG. 9, one lower reversing suction cylinder 30 or roll in the group $R_n$ with single-wire draw has been omitted from its usual location, and in its place, a calender roll 10 and a guide roll 22*a*A of the drying wire 21 are arranged. The arrangement of intermediate calendering as shown in FIG. 9 operates so that the drying wire 21 is separated from the drying 20 cylinder in the group $R_n$ by means of the guide roll 22*a*A so that the web W follows the smooth face 20' of the cylinder 20 into the first calendering nip NK1. After the first calendering nip NK1, the web W follows the smooth face 10' of the calender roll 10. On the calender roll 10, the web W is supported from below by means of a support wire 21S which is guided by its guide rolls 22S. When the support wire 22S is separated from the web W, the web W is passed on the face 10' of the calender roll 10 into the second calendering nip NK2. After the second calendering nip, the web W follows the smooth face 20' of the latter drying cylinder 20 and enters under the drying wire 21 after its guide roll 22*a*A. A support wire 21S is not always indispensable, for which reason the support wire 21S and its associated guide rolls 22S are drawn with dashed lines in FIG. 9.

Figure 10:
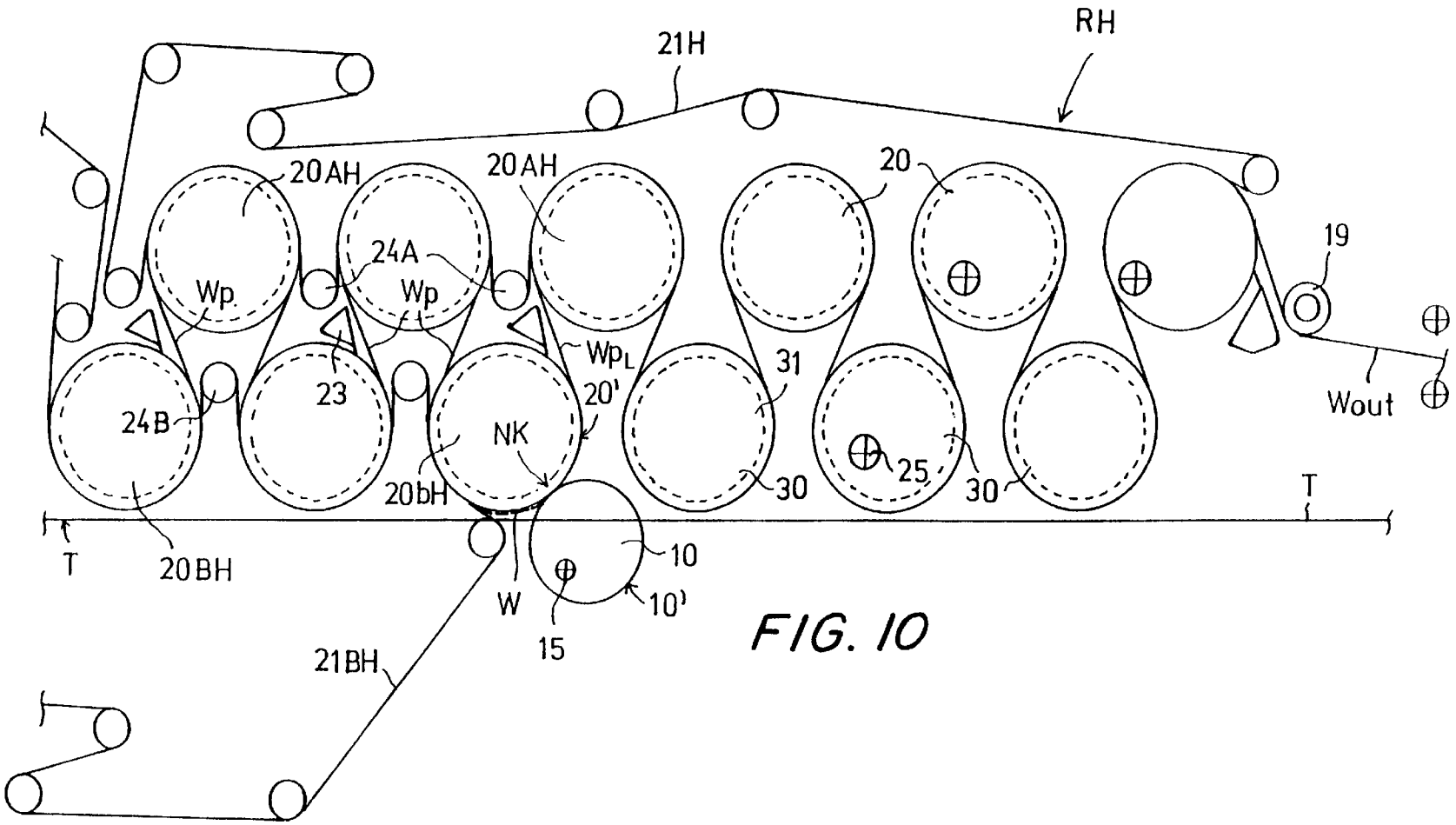
FIG. 10 shows a fifth embodiment of the dryer section in accordance with the invention.

FIG. 10 shows the fifth embodiment of the invention. As shown in FIG. 10, the intermediate calendering nip NK is arranged in the last group RH in the dryer section which is a so-called hybrid group and comprises portions with single-wire draw and twin-wire draw. In the group RH, initially there is a portion with twin-wire draw in which there are a row of upper drying cylinders 20AH and a row of lower drying cylinders 20BH. An upper wire 21H runs through the whole group RH initially over the upper cylinders 20AH when guided by the guide rolls 24A, after which the wire runs both over the upper cylinders 20 and over the lower reversing suction cylinders 30 or rolls while applying the single-wire draw.

In FIG. 10, in connection with the last lower cylinder 20*b*H in the portion with twin-wire draw in the group RH, in accordance with the invention, a nip NK of intermediate calendering is arranged and is formed in connection with the smooth-faced 10' calender roll 10. The calender roll 10 is provided with a drive 15 of its own for operatively rotating it, and its center is arranged slightly below a floor level T—T of the paper machine hall. The web W enters into the nip NK of intermediate calendering on the smooth face 20' of the lower cylinder 20*b*H and follows the face of the cylinder 20*b*H after the nip NK and is transferred as the last free draw WPL onto the upper cylinder 20AH, in whose area the portion with single-wire draw starts. In the other respects, the construction is similar to that described above. Even though in FIG. 10, the hybrid group comprises a portion with twin-wire draw first and a portion with single-wire draw only thereafter, within the scope of the invention it is also possible to apply a corresponding nip NK of intermediate calendering in a hybrid group in which there is initially a portion with single-wire draw and thereafter, a portion with twin-wire draw.

Figure 10A:
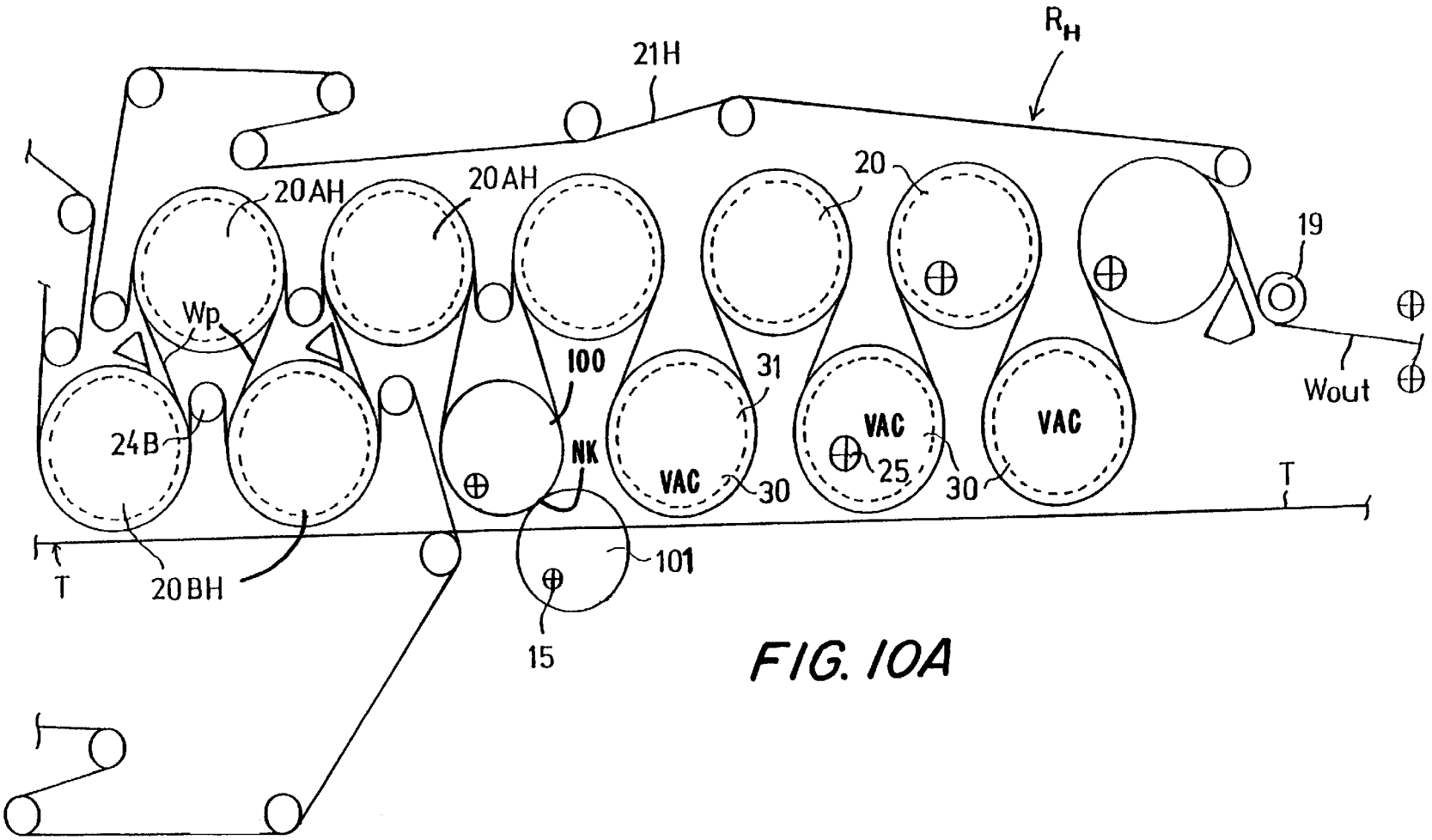
FIG. 10A shows a modification of the dryer section in accordance with the invention shown in FIG. 10 in which the calendering nip is formed between two calender rolls.

FIG. 10A shows a modification of the embodiment of FIG. 10 wherein the calendering nip NK is formed between two calendering rolls 100,101. To this end, a calender roll 100 is arranged in the loop of the upper wire 21H, between the twin-wire portion of the hybrid group $R_H$ and the single-wire portion thereof, and forms a calendering nip NK with calender roll 101. In operation, the web is carried in an open draw from the last upper drying cylinder 20AH in the twin-wire portion of the hybrid group to the calender roll 100, around the calender roll 100 into and through the calendering nip NK formed between the calender rolls 100,101 and then in an open draw into connection with the first drying cylinder 20 in the single-wire portion of the hybrid group.

Figure 11:
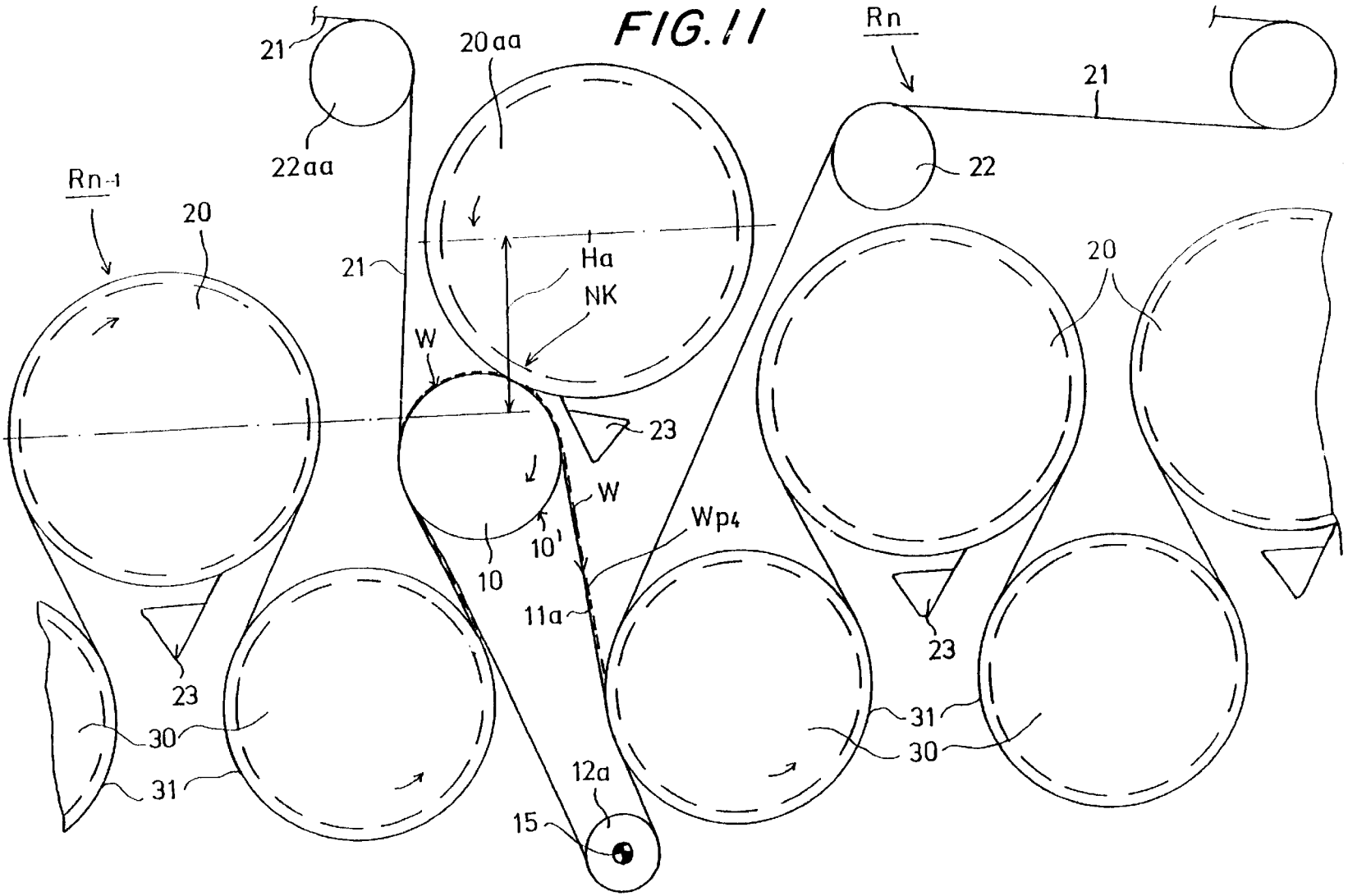
FIG. 11 shows a sixth embodiment of the dryer section in accordance with the invention.

FIG. 11 shows the sixth embodiment of the invention which is not apparently as equally advantageous as the first five embodiments described above. According to FIG. 11, between two groups $R_n$ and $R_{n-1}$ with single-wire draw, a separate drying cylinder 20*aa* or a corresponding calender roll is arranged, which is either soft-faced or hard-faced, heated or not heated. The additional cylinder 20*aa* or roll is arranged by a length or dimension Ha higher than the level of the location of the upper cylinders 20 in the single-wire draw. In connection with the former lower quarter of the additional cylinder 20*aa* or roll, a nip NK of intermediate calendering is arranged and to which the web W is passed on support of the drying wire 21 of the former group $R_{n-1}$ and of the calender roll 10. After the roll 10, the drying wire 21 runs further guided by the guide roll 22*aa*. The web W to be calendered is passed into the calendering nip NK on the smooth face 10' of the calender roll 10, and after the nip NK the web W further follows the smooth face 10' of the roll 10 from which face it is passed as a downwardly inclined, almost vertical, draw $W_{p4}$ onto the first lower reversing suction cylinder 30 in the latter group $R_n$. The cylinder 20*aa* does not have to be a heated cylinder because the web W does not run over the cylinder but just contacts the cylinder in the nip NK of intermediate calendering. It should be emphasized further that, instead of an extra cylinder 20*aa*, it is also possible to use a calender roll having a smaller diameter.

In FIG. 11, it is shown as an option that a calendering belt 11*a* is passed over the calender roll 10, which belt is guided by a guide roll 12*a* driven (rotated) by drive means 15. By means of the calendering belt 11*a*, it is possible to close the gap $W_{p4}$ of the web W, which would otherwise be open, by passing the calendering belt 11*a* into contact with the first reversing suction cylinder 30. The calendering belt 11*a* is not always necessary, even if it has the advantage of permitting closing of the open gap $W_{p4}$.

In FIGS. 1–11, the calender roll 10,100,101 of the nip NK or nips NK,NK'; NK1 ,NK2 of intermediate calendering can be a calender roll provided with a hard coating 10' or with a soft coating. Especially, the calender including the calendering nip(s) NK,NK'; NK1,NK2 may be a so-called soft calender wherein one roll has a soft roll cover and the other roll is heated. The cross-direction distribution of the nip pressure in the calendering nip NK or nips can be arranged to be profiled in a way in itself known by means of a technique known from calenders, for example, by adjusting the cross-direction temperature profile of the roll 10, 100, 101 or of the opposite drying cylinder 20*a*; 20A*a*;20B*h*; 20*b*H,20*aa* (if present) and/or of the calender roll 10,100, 101 by means of an induction heating device or by using a calender roll 10,100,101 adjustable in zones, for example the current assignee's Sym ZS roll.

An extended nip NKP of intermediate calendering as shown in FIG. 2A can also be used in the positions of the calendering nip NK shown in FIGS. 3–11 for which it is suitable in view of the utilization of space or other circumstances. Similarly, it is possible to use a heat treatment device 28 enhancing the calendering effect and/or an equivalent profiling device, such as a steam box or an infrared heater, as shown in FIG. 2B, also in other positions besides that shown in FIG. 2B and in the other dryer sections shown in the other figures, of course, in consideration of the need to increase the calendering effect, the utilization of space, and of other practical circumstances. In this respect, in FIG. 2B, reference is made to the treatment device 28', whose effect is applied through the treatment gap 29' to the lower face of the web W, i.e., to the face opposite to the face of the effect of the device 28.

The surface material of the calender roll 10,10P,100,101 is selected so that, depending on the place of application, the face of the calender roll attempts either to reject the web W or to adhere to the web W.

A number of the nips NK of intermediate calendering described above can be arranged in the different positions described above, and then, in the same dryer section, it is possible to apply different combinations of the locations and arrangements of the calendering nips NK;NKP in accordance with the different embodiments of the invention. Typically, in the invention, one, two or three nips NK of intermediate calendering are used, which are preferably arranged in the dry end of the dryer section, preferably in an area in which the dry solids content of the web W is ka> about 60%.

The linear load in the calendering nip NK;NKP depends on the position of the calendering nip NK,NKP, on the thickness and dry solids content of the web W passing through the calendering nip NK;NKP, and on the paper grade produced. Typically, the linear load in a calendering nip NK is selected in the range of 0 to about 300 kN/m, preferably in the range of 0 to about 80 kN/m.

As is well known in the art, besides compression, a raised temperature also promotes the "ironing effect" of calendering. For this reason, in the drying cylinder 20*a*;20A*a*;20B*b*; 20*b*H;20*aa* that forms a nip NK;NKP of intermediate calendering together with a calendering roll 10, a level of surface temperature T from about 60° C. to about 250° C. is used, which is produced by means of normal steam heating of the drying cylinder concerned. In the event that the calendering nip is formed by two calender rolls instead of by a calender roll and a drying cylinder, e.g., as shown in FIG. 1B, then one or both calender rolls may be heated, in particular, when a soft calender is formed, i.e., when one roll is a soft-faced roll and the other roll is heated. If necessary, the drying cylinder, in connection with which a calendering nip NK;NKP is arranged, is provided with separate regulation of the temperature, which regulation can, if necessary, also be profiled in view of control of the cross-direction profile of the calendering nip pressure.

According to the invention, when a relatively low linear load is employed in a nip NK;NKP or nips NK,NK';NK1, NK2 of intermediate calendering, generally a normal drying cylinder 20*a*;20A*a*;20B*b*;20*b*H;20*aa* with a cast-iron mantle is adequate. Of course, as the drying cylinder 20*a*;20A*a*;20B*b*;20*b*H;20*aa*, it is also possible to use a drying cylinder of special reinforcement or a heated calender roll proper. Also, both of the rolls/cylinders that form the NK nips at the calendering nip can be provided with heating and/or with regulation of the temperature profile or level in view of regulation of the profile of linear load in the nip NK;NKP or nips. The axle journals of the calender roll 10 are connected with power units in themselves known, which are not shown and by whose means the nip-pressure loading of the calendering nip NK;NKP is produced.

Overall, it is an important feature and effect of all of the embodiments of the invention described above that the arrangement of a calendering nip NK;NKP or nips in the dryer section does not increase the length of the dryer section, but the drying capacity of the dryer section is slightly increased or at least remains unchanged irrespective of the location of the calendering nip NK;NKP or nips. Thus, the invention is also suitable for use in modernizations of paper machines, in which case, with slight modification work, it is possible to place one or several nips NK;NKP of intermediate calendering in suitable locations in the dryer section. In such a case, in some cases, when the present invention is applied, it is possible to omit the machine stack, for example a soft calender, completely. In this case, the length of the dryer section can be increased with the space that was occupied by the machine stack and, thus, the drying capacity can be increased, for example, when the running speed of a paper machine is increased in connection with modernization.

In a preferred embodiment of the present invention, a calender roll 10 provided with a soft coating 10' is used so that a so-called soft calender nip is arranged in different positions in accordance with the present invention. In such a case, the hardness of the coating 10' of the calender roll 10 is preferably selected in the range of from about 80 to about 95 Shore D, preferably in the range of from about 88 to about 92 Shore D.

With respect to the embodiments in which the calendering nip is formed between two calender rolls 100, 101 (or 101*p*), each of the calender rolls 100,101,101*p* may be provided with mechanical drive devices as represented by 110 in FIG. 7A. Some advantages of the embodiments wherein two calender rolls 100,101 are used include the fact that the replacement and service of the calender rolls 100,101 is easier in comparison to the replacement and service of other types of rolls, it is possible to use as the calender rolls 100,101 in the dryer section, conventional calender rolls used at the present time, e.g., in calender stacks, and the structure of the calendering nip formed by the two calender rolls 100,101 allows a higher nip pressure with the result that the quality of the paper that is being manufactured is improved. In general, the calender rolls used herein are rolls which do not include internal steam heating systems as in drying cylinders to distinguish from drying cylinders which are steam heated from an interior thereof. Rather, by contrast, the calender rolls may be heated by circulating hot oil or water in the roll mantle. In addition, as the mantle faces of the calender rolls 100,101, it is possible to use various surface materials with a view toward improving the quality, two-sidedness and the adherence/detachment properties of the web.

Another advantage of the use of two calender rolls to form a calendering nip instead of a calender roll and a drying cylinder is that the control of the straightness of the calendering nip, i.e., the nip pressure profile in the cross direction is easier with two calender rolls than with one calender roll and a drying cylinder, or in a nip formed by two drying cylinders.

The examples provided above are not meant to be exclusive. Many other variations of the present invention would be obvious to those skilled in the art, and are contemplated to be within the scope of the appended claims.

We claim:

1. A dryer section of a paper machine for drying a web, comprising a first group with single-wire draw including heated drying cylinders arranged in a first row, reversing suction cylinders or rolls arranged in a second row below said first row of drying cylinders and each between an adjacent pair of said drying cylinders, and a drying wire engaging the web and running over said drying cylinders and said reversing suction cylinders or rolls whereby said reversing suction cylinders or rolls are arranged inside a loop of said drying wire, a first calender roll, said drying wire being arranged to run over said first calender roll such that the web is transferred from said drying wire as a closed draw onto said first calender roll to run over and in contact with said first calender roll, a second calender roll arranged to form a calendering nip with said first calender roll through which the web passes, the web being guided to run over said first calender roll after said calendering nip, and wherein the dryer section does not include a group with single-wire draw having heated drying cylinders arranged in a first row and reversing suction cylinders or rolls arranged in a second row above said first row of drying cylinders situated adjacent said calendering nip formed by said first and second calender rolls.

2. The dryer section of claim 1, wherein said first calender roll is arranged at one end of said first group with single-wire draw, further comprising a second group with single-wire draw including heated drying cylinders arranged in a first row, reversing suction cylinders or rolls arranged in a second row below said first row of drying cylinders and each between an adjacent pair of said drying cylinders, and a drying wire engaging the web and running over said drying cylinders and said reversing suction cylinders or rolls whereby said reversing suction cylinders or rolls are arranged inside a loop of said drying wire, said second group with single-wire draw being arranged successively after said first group with single-wire draw in a running direction of the web, a first guide roll arranged in the loop of said drying wire in said first group to separate said drying wire in said first group from the web at a first location about said first calender roll, and a second guide roll arranged in the loop of said drying wire in said second group to guide said drying wire in said second group into engagement with the web at a second location about said first calender roll, said calendering nip being formed between said first and second locations and the web being transferred from said first group to said second group over said first calender roll.

3. The dryer section of claim 1, further comprising a calendering belt and means for guiding said calendering belt in a loop and through said calendering nip, said second calender roll being situated in said loop of said calendering belt.

4. The dryer section of claim 1, wherein said second calender roll comprises an extended nip roll such that said calendering nip constitutes an extended nip.

5. The dryer section of claim 4, wherein said extended nip roll comprises a hose roll having a flexible hose mantle and at least one hydraulically loaded glide shoe arranged in an interior of said hose mantle for producing a nip pressure in a calendering zone of said extended nip.

6. The dryer section of claim 5, wherein said at least one glide shoe comprises a series of glide shoes, said extended nip roll further comprising loading means for individually loading each of said glide shoes in said series of glide shoes and control means for controlling a linear load profile of said loading means in a machine direction and/or in a cross-machine direction by independently regulating the hydraulic loading of each of said glide shoes in said series of glide shoes.

7. The dryer section of claim 1, further comprising calendering intensification means arranged in advance of said calendering nip and in opposed relationship to said first calender roll for intensifying the calendering in said calendering nip.

8. The dryer section of claim 7, wherein said calendering intensification means are selected from a group consisting of a steam supply box, a web heating device, a web profiling device and a water-mist spraying device.

9. The dryer section of claim 7, wherein said calendering intensification means are arranged to control at least one of a cross-direction moisture profile of said calendering nip, a temperature profile of said calendering nip and a linear load profile of said calendering nip.

10. The dryer section of claim 1, wherein said first calender roll is arranged between a first and last one of said drying cylinders in said first group with single-wire draw, further comprising a guide roll spaced from said first calender roll such that said drying wire is separated from the web as the web runs over said first calender roll at a first location and is passed into engagement with the web as the web runs over said first calender roll at a second location downstream of said first location, said second calender roll being arranged to define said calendering nip with said first calender roll between said first and second locations.

11. A dryer section of a paper machine for drying a paper web, comprising a group with single-wire draw including heated drying cylinders arranged in a first row, reversing suction cylinders or rolls arranged in a second row below said first row of drying cylinders and each between an adjacent pair of said drying cylinders, and a drying wire engaging the web and running over said drying cylinders and said reversing suction cylinders or rolls whereby said reversing suction cylinders or rolls are arranged inside a loop of said drying wire, a group with twin-wire draw arranged after said group with single-wire draw in a running direction of the web, said group with twin-wire draw comprising a first row and a second row of heated drying cylinders between which the web has free unsupported draws, a first wire for pressing the web against said drying cylinders in the first row, first guide means for guiding a run of said first wire, a second wire for pressing the web against said drying cylinders in the second row, and second guide means for guiding a run of said second wire, a first calender roll arranged between said group with single-wire draw and said group with twin-wire draw, said drying wire in said group with single-wire draw being arranged to run over said first calender roll such that the web is transferred from said drying wire in said group with single-wire draw as a closed draw onto said first calender roll to run over and in contact with said first calender roll, and a second calender roll arranged to form a calendering nip with said first calender roll through which the web passes, the web running over said first calender roll into said calendering nip and over said second calender roll after said calendering nip, said first wire in said group with twin-wire draw being guided into contact with the web about said second calender roll and separated from the web about or immediately after said second calender roll such that the web is passed as an open draw from said second calender roll or immediately thereafter to a first one of said drying cylinders in said second row of drying cylinders.

12. A dryer section of a paper machine for drying a web, comprising a group with twin-wire draw comprising a first row and a second row of heated drying cylinders between which the web being dried has free unsupported draws, a first wire for pressing the web against said drying cylinders in the first row, first guide means for guiding a run of said first wire, a second wire for pressing the web against said drying cylinders in the second row, and second guide means for guiding a run of said second wire, a first calender roll arranged in said twin-wire draw group, and a second calender roll arranged to form a calendering nip with said first calender roll through which the web passes, said first guide means, said drying cylinders in the first row, said second guide means and said drying cylinders in said second row being arranged such that the web is guided from one of said drying cylinders in said first row into said calendering nip and from said calendering nip to one of said drying cylinders in said second row.

13. The dryer section of claim 12, wherein said first guide means are arranged to press the web against said first calender roll and said second guide means are arranged to press the web against said second calender roll, said first guide means, said one of said drying cylinders in said first row, said second guide means and said one of said drying cylinders in said second row being arranged such that the web is transferred from said one of said drying cylinders in said first row onto an outer surface of said second calender roll, runs between said outer surface and said second drying wire over a sector of said second calender roll, runs over an additional sector of said second calender roll in which the web has an exposed face into said calendering nip, runs over a sector of said first calender roll in which the web has an exposed face, runs between said outer surface and said first drying wire over a sector of said first calender roll and is transferred from said outer surface of said first calender roll to said one of said drying cylinders in the second row.

14. The dryer section of claim 12, wherein said first calender roll is arranged between a pair of said drying cylinders in said first row and said second calender roll is arranged between a pair of said drying cylinders in said second row.

15. The dryer section of claim 12, wherein said first guide means are arranged to remove said first drying wire from contact with the web about or immediately after said one of said drying cylinders in the first row and said second guide means are arranged to engage said second drying wire with the web about or immediately before said one of said drying cylinders in the second row after said calendering nip such that the web passes from said one of said drying cylinders in said first row through said calendering nip to said one of said drying cylinders in the second row without contacting said first drying wire after it separated therefrom.

16. A dryer section of a paper machine for drying a web, comprising a hybrid group comprising a twin-wire draw portion including a first row and a second row of heated drying cylinders between which the web has free unsupported draws, a first wire for pressing the web against said drying cylinders in the first row, first guide means for guiding a run of said first wire, a second wire for pressing the web against said drying cylinders in the second row, and second guide means for guiding a run of said second wire, a single-wire draw portion including heated drying cylinders arranged in a first row, reversing suction cylinders or rolls arranged in a second row below said first row of drying cylinders and each between an adjacent pair of said drying cylinders, said first wire engaging the web and running over said drying cylinders of said single-wire draw portion and said reversing suction cylinders or rolls of said single-wire draw portion whereby said reversing suction cylinders or rolls are arranged inside a loop of said first wire;

a first calender roll arranged in said single-wire draw portion, said first guide means being arranged to provide the web with a free draw to and from said first calender roll such that the web runs on an outer surface of said first calender roll having an exposed face, and a second calender roll arranged to form a calendering nip with said first calender roll through which the web passes.

17. The dryer section of claim 17, wherein said single-wire draw portion is arranged after said twin-wire draw portion in a running direction of the web.

18. A dryer section of a paper machine for drying a web, comprising a first group with single-wire draw including heated drying cylinders arranged in a first row, reversing suction cylinders or rolls arranged in a second row below said first row of drying cylinders and each between an adjacent pair of said drying cylinders, and a drying wire engaging the web and running over said drying cylinders and said reversing suction cylinders or rolls whereby said reversing suction cylinders or rolls are arranged inside a loop of said drying wire, a first calender roll arranged at an end of said first group with single-wire draw, said drying wire being arranged to run over said first calender roll at a first location such that the web is transferred from said drying wire as a closed draw onto said first calender roll to run over and in contact with said first calender roll, a second calender roll arranged to form a calendering nip with said first calender roll through which the web passes, and at least one additional group with single-wire draw including heated drying cylinders arranged in a first row, reversing suction cylinders or rolls arranged in a second row below said first row of drying cylinders and each between an adjacent pair of said drying cylinders, and a drying wire engaging the web and running over said drying cylinders and said reversing suction cylinders or rolls whereby said reversing suction cylinders or rolls are arranged inside a loop of said drying wire, said first group with single-wire draw constituting the last drying group in the dryer section in a running direction of the web.

* * * * *